United States Patent [19]

Yagihara et al.

[11] 4,436,808

[45] Mar. 13, 1984

[54] SILVER HALIDE COLOR PHOTOGRAPHIC LIGHT-SENSITIVE MATERIAL

[75] Inventors: Morio Yagihara; Tsumoru Hirano; Keiji Mihayashi, all of Kanagawa, Japan

[73] Assignee: Fuji Photo Film Co., Ltd., Kanagawa, Japan

[21] Appl. No.: 469,660

[22] Filed: Feb. 25, 1983

[30] Foreign Application Priority Data

Feb. 25, 1982 [JP] Japan ..... 57-29683

[51] Int. Cl.[3] ..... G03C 7/16; G03C 5/24

[52] U.S. Cl. ..... 430/381; 430/505; 430/548; 430/555; 430/627

[58] Field of Search ..... 430/381, 505, 548, 555, 430/627

[56] References Cited

U.S. PATENT DOCUMENTS

| | | | |
|---|---|---|---|
| 2,592,303 | 4/1952 | Loria et al. | 430/381 |
| 3,926,436 | 12/1975 | Monbaliu et al. | 430/548 |
| 4,264,723 | 4/1981 | Ichijima et al. | 430/555 |
| 4,310,623 | 1/1982 | Watanabe et al. | 430/555 |
| 4,383,027 | 5/1983 | Ichikawa et al. | 430/555 |

*Primary Examiner*—J. Travis Brown

*Attorney, Agent, or Firm*—Sughrue, Mion, Zinn, Macpeak and Seas

[57] ABSTRACT

A silver halide color photographic light-sensitive material comprising a support having thereon a silver halide emulsion layer containing a magenta color image forming polymer coupler latex which is capable of forming a dye upon coupling with an oxidation product of an aromatic primary amine developing agent and which is a homopolymer or copolymer having a repeating unit derived from a monomer coupler represented by the following general formula (I):

(I)

wherein $R_1$ represents hydrogen, a lower alkyl group containing from 1 to 4 carbon atoms or a chlorine atom; $R_2$ and $R_3$, which may be the same or different, each represents an unsubstituted or substituted alkylene group which may be a straight chain or a branched chain, an unsubstituted or substituted arylene group or an unsubstituted or substituted aralkylene group; X represents —CONH— or —COO—; Y represents —O—, —S—, —SO—, —$SO_2$—, —CONH— or —COO—; Ar represents an unsubstituted or substituted phenyl group; $R_4$ represents an unsubstituted or substituted anilino group, an unsubstituted or substituted acylamino group or an unsubstituted or substituted ureido group; l represents 0 or 1; m represents 0 or 1; and n represents 0 or 1.

The magenta color image forming polymer coupler latex has a good color forming property and is capable of forming a dye with a high yield and without formation of undesired stains and fogs, and the silver halide color photographic light-sensitive material containing the magenta color image forming polymer coupler latex has good film strength and a reduced layer thickness and provides a stable magenta image having improved graininess and sharpness and a good fastness to light, heat, and humidity. A method of forming a color image using the silver halide color photographic light-sensitive material is also described.

19 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material containing a novel 2-equivalent magenta color image forming polymer coupler latex capable of coupling with an oxidation product of an aromatic primary amine developing agent.

BACKGROUND OF THE INVENTION

It is well known that for the color development of a silver halide photographic light-sensitive material, after exposure, an oxidized aromatic primary amine developing agent can be reacted with a dye forming coupler to obtain a color image.

It is also known that, for the color development of a silver halide color photographic material, an oxidized aromatic primary amine color developing agent can be reacted with a coupler to form a dye such as an indophenol, an indoaniline, an indamine, an azomethine, a phenoxazine, a phenazine, and the like, thus forming a color image. In this procedure, the subtractive color process is ordinarily used for color reproduction, and silver halide emulsions which are selectively sensitive to blue, green and red light, and yellow, magenta and cyan color image formers, which are respectively the complementary colors of blue, green and red, are employed. For example, a coupler of the acylacetanilide or benzoylmethane type is used for forming a yellow color image; a coupler of the pyrazolone, pyrazolobenzimidazole, cyanoacetophenone or indazolone type is generally used for forming a magenta color image; and a phenolic coupler, such as a phenol and a naphthol, is generally used for forming a cyan color image.

Color couplers must satisfy various requirements. For example, it is necessary that they have a good spectral property and provide a dye image having excellent stability to light, temperature, and humidity for a long period of time upon color development.

It is also required in a multilayer color photographic light-sensitive material that each coupler is fixed in a layer separated from each other in order to reduce color mixing and improve color reproduction. Many methods for rendering a coupler diffusion-resistant are known. One method is to introduce a long chain aliphatic group into a coupler molecule in order to prevent diffusion. Couplers according to such a method require a step of addition to an aqueous gelatin solution by solubilizing in alkali, or a step of dispersing in an aqueous gelatin solution by dissolving in a high boiling organic solvent, since the couplers are immiscible with an aqueous gelatin solution. Such color couplers may cause crystal formation in a photographic emulsion. Furthermore, when using a high boiling organic solvent, a large amount of gelatin must be employed since the high boiling organic solvent makes an emulsion layer soft. Consequently, this increases the thickness of the material even though it is desirable to reduce the thickness of the emulsion layer.

Another method for rendering a coupler diffusion-resistant is to utilize a polymer coupler latex obtained by polymerization of a monomeric coupler. An example of a method of adding a polymer coupler in a latex form to a hydrophilic colloid composition is a method in which a latex prepared by a conventional emulsion polymerization method is directly added to a gelatino silver halide emulsion and a method in which a hydrophobic polymer coupler obtained by polymerization of a monomeric coupler is dispersed in a latex form in an aqueous gelatin solution. Some examples of the former emulsion polymerization methods include an emulsion polymerization method in an aqueous gelatin phase as described in U.S. Pat. No. 3,370,952 and an emulsion polymerization method in water as described in U.S. Pat. No. 4,080,211. An example of the latter method in which a hydrophobic polymer coupler is dispersed in a latex form in gelatin is described in U.S. Pat. No. 3,451,820. The method of adding a polymer coupler in a latex form to a hydrophilic colloid composition has many advantages in comparison with other methods. For example, the deterioration of strength of the film formed is small, because the hydrophobic substance is in a latex form. Also, since the latex can contain coupler monomers in a high concentration, it is easy to incorporate couplers in a high concentration into a photographic emulsion, and the increase of viscosity is small. Furthermore, color mixing is prevented, since a polymer coupler is completely immobilized and the crystallization of couplers in the emulsion layer is small. In particular, when the polymer coupler latex prepared by an emulsion polymerization method is used, the step of adding the coupler to a coating solution can be simplified, since the use of a high boiling organic solvent or an alkali is not necessary and a special dispersing method is not required. Moreover, the thickness of the layer can be reduced, since an organic solvent is not contained therein.

With respect to the addition of these polymer couplers in a latex form to a gelatino silver halide emulsion, there are described, for example, 4-equivalent magenta polymer coupler latexes and methods of preparation thereof in U.S. Pat. No. 4,080,211, British Pat. No. 1,247,688, and U.S. Pat. No. 3,451,820, 2-equivalent magenta polymer coupler latexes in West German Pat. No. 2,725,591, and U.S. Pat. No. 3,926,436 and cyan polymer coupler latexes in U.S. Pat. No. 3,767,412.

SUMMARY OF THE INVENTION

Therefore, an object of the present invention is to provide a color photographic light-sensitive material containing a novel 2-equivalent magenta color image forming polymer coupler latex that forms a color image having extremely good graininess upon development processing.

Another object of the present invention is to provide a color photographic light-sensitive material containing a novel 2-equivalent magenta color image forming polymer coupler latex that forms a color image fast to light, heat, and humidity after development processing.

Another object of the present invention is to provide a color photographic light-sensitive material containing a novel 2-equivalent magenta color image forming polymer coupler latex which does not affect the silver halide after color development processing.

Still another object of the present invention is to provide a color photographic light-sensitive material containing a novel 2-equivalent magenta color image forming polymer coupler latex which forms a dye in a high yield without the occurrence of undersirable fog and stain.

A further object of the present invention is to provide a color photographic light-sensitive material containing a novel 2-equivalent magenta color image forming polymer coupler latex which has an increased conversion rate of coupler to dye and an improved resistance to decrease in color forming property due to the attack of chemical substances.

A further object of the present invention is to provide a color photographic light-sensitive material having a reduced layer thickness and an improved sharpness.

A still further object of the present invention is to provide a method of forming a magenta color image by development of a silver halide emulsion in the presence of a novel 2-equivalent magenta color image forming polymer coupler latex.

A still further object of the present invention is to provide a silver halide color photographic light-sensitive material containing a novel 2-equivalent magenta color image forming polymer coupler latex, a photographic processing method or an image forming method for using the material.

Other objects of the present invention will be apparent from the following detailed description and examples.

As a result of extensive investigations, it has now been found that these objects of the present invention are accomplished by the use of a 2-equivalent magenta color image forming polymer coupler latex which is a homopolymer or copolymer having a repeating unit derived from a monomer coupler represented by the following general formula (I):

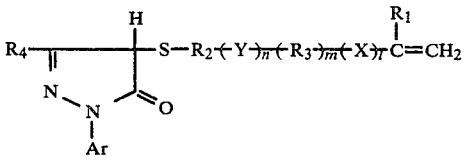

(I)

wherein $R_1$ represents hydrogen, a lower alkyl group containing from 1 to 4 carbon atoms or a chlorine atom; $R_2$ and $R_3$, which may be the same or different, each represents an unsubstituted or substituted alkylene group which may be a straight chain or a branched chain, an unsubstituted or substituted arylene group or an unsubstituted or substituted aralkylene group; X represents —CONH— or —COO—; Y represents —O—, —S—, —SO—, —$SO_2$—, —CONH— or —COO—; Ar represents an unsubstituted or substituted phenyl group; $R_4$ represents an unsubstituted or substituted anilino group, an unsubstituted or substituted acylamino group or an unsubstituted or substituted ureido group; l represents 0 or 1; m represents 0 or 1; and n represents 0 or 1.

More specifically, the objects of the present invention can be accomplished with a color photographic light-sensitive material comprising a support having thereon at least one silver halide emulsion layer containing a 2-equivalent magenta color image forming polymer coupler latex which is a novel homopolymer having a repeating unit represented by the general formula (II) described below, or a novel copolymer having the repeating unit described below and a non-color forming unit which does not couple with the oxidation product of an aromatic primary amine developing agent.

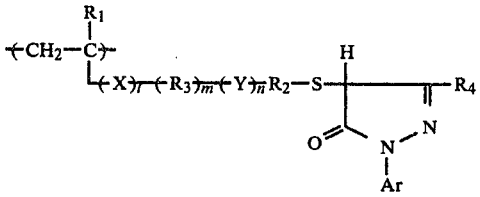

(II)

wherein $R_1$, $R_2$, $R_3$, $R_4$, X, Y, Ar, l, m and n have the same meanings as defined in the general formula (I) above.

DETAILED DESCRIPTION OF THE INVENTION

The novel 2-equivalent magenta color image forming polymer coupler latex according to the present invention includes a homopolymer having a repeating unit derived from a monomer coupler represented by the general formula (I), and a copolymer having the repeating unit according to formula (II) and at least one non-color forming unit containing at least one ethylene group which does not have an ability of oxidative coupling with an aromatic primary amine developing agent.

The novel 2-equivalent magenta color image forming polymer coupler latex used in the color photographic light-sensitive material of the present invention includes a homopolymer and a copolymer derived from a novel 2-equivalent magenta color image forming monomer coupler having a coupling releasable group which is bonded to the coupling active position of a pyrazolone ring through a sulfur atom and contains a polymerizable group therein.

The novel 2-equivalent magenta color image forming polymer coupler latex according to the present invention does not adversely affect the silver halide and can form a color image fast to heat and light. In addition, it can provide a color image having an extremely improved graininess.

In the above-described formula (I), $R_1$ represents hydrogen, a lower alkyl group having from 1 to 4 carbon atoms, or a chlorine atom; $R_2$ and $R_3$ each represents an unsubstituted or substituted alkylene group, preferably having from 1 to 10 carbon atoms, which may be a straight chain or a branched chain, an unsubstituted or substituted arylene group having from 6 to 10 carbon atoms, or an unsubstituted or substituted aralkylene group having from 7 to 10 carbon atoms. Preferred examples of the alkylene group include a methylene group, a methylmethylene group, a dimethylmethylene group, a dimethylene group, a trimethylene group, a tetramethylene group, a pentamethylene group, a hexamethylene group, an octamethylene group, a decylmethylene group, etc. Preferred examples of the arylene group include a phenylene group, a naphthylene group, etc. Preferred examples of the aralkylene group include a benzylidene group, etc.

X represents —CONH— or —COO—; Y represents —O—, —S—, —SO—, —$SO_2$—, —CONH— or —COO—; Ar represents an unsubstituted or substituted phenyl group; $R_4$ represents an unsubstituted or substituted anilino group, an unsubstituted or substituted acylamino group or an unsubstituted or substituted ureido group; l represents 0 or 1; m represents 0 or 1; and n represents 0 or 1.

Substituents for the alkylene group, the arylene group or the aralkylene group represented by $R_2$ or $R_3$ include an aryl group (for example, a phenyl group, etc.), a nitro group, a hydroxy group, a cyano group, a sulfo group, an alkoxy group (for example, a methoxy group, etc.), an aryloxy group (for example, a phenoxy group, etc.), an acyloxy group (for example, an acetoxy group, etc.), an acylamino group (for example, an acetylamino group, etc.), a sulfonamido group (for example, a methanesulfonamido group, etc.), a sulfamoyl group (for example, a methylsulfamoyl group, etc.), a halogen atom (for example, a fluorine atom, a chlorine atom, a bromine atom, etc.), a carboxy group, a carbamoyl group (for example, a methylcarbamoyl group, etc.), an alkoxycarbonyl group (for example, a methoxycarbonyl group, etc.), a sulfonyl group (for example, a methylsulfonyl group, etc.), and the like. When two or more substituents are present, they may be the same or different.

Ar represents an unsubstituted or substituted phenyl group. Substituents for the phenyl group include an alkyl group (for example, a methyl group, an ethyl group, etc.), an alkoxy group (for example, a methoxy group, an ethoxy group, etc.), an aryloxy group (for example, a phenoxy group, etc.), an alkoxycarbonyl group (for example, a methoxycarbonyl group, etc.), an acylamino group (for example, an acetylamino group, etc.), a carbamoyl group, an alkylcarbamoyl group (for example, a methylcarbamoyl group, an ethylcarbamoyl group, etc.), a dialkylcarbamoyl group (for example, a dimethylcarbamoyl group, etc.), an arylcarbamoyl group (for example, a phenylcarbamoyl group, etc.), an alkylsulfonyl group (for example, a methylsulfonyl group, etc.), an arylsulfonyl group (for example, a phenylsulfonyl group, etc.), an alkylsulfonamido group (for example, a methanesulfonamido group, etc.), an arylsulfonamido group (for example, a phenylsulfonamido group, etc.), a sulfamoyl group, an alkylsulfamoyl group (for example, an ethylsulfamoyl group, etc.), a dialkylsulfamoyl group (for example, a dimethylsulfamoyl group, etc.), an alkylthio group (for example, a methylthio group, etc.), an arylthio group (for example, a phenylthio group, etc.), a cyano group, a nitro group, a halogen atom (for example, a fluorine atom, a chlorine atom, a bromine atom, etc.), and the like. When two or more substituents are present, they may be the same or different.

Particularly preferred substituents for the phenyl group include a halogen atom, an alkyl group, an alkoxy group, an alkoxycarbonyl group and a cyano group.

$R_4$ represents an unsubstituted or substituted anilino group, an unsubstituted or substituted acylamino group (for example, an alkylcarbonamido group, a phenylcarbonamido group, an alkoxycarbonamido group, a phenoxycarbonamido group, etc.) or an unsubstituted or substituted ureido group (for example, an alkylureido group, a phenylureido group, etc.). Substituents for these groups include a halogen atom (for example, a fluorine atom, a chlorine atom, a bromine atom, etc.), a straight chain or branched chain alkyl group (for example, a methyl group, a tert-butyl group, an octyl group, a tetradecyl group, etc.), an alkoxy group (for example, a methoxy group, an ethoxy group, a 2-ethylhexyloxy group, a tetradecyloxy group, etc.), an acylamino group (for example, an acetamido group, a benzamido group, a butanamido group, an octanamido group, a tetradecanamido group, an α-(2,4-di-tert-amylphenoxy)acetamido group, an α-(2,4-di-tert-amylphenoxy)-butyramido group, an α-(3-pentadecylphenoxy)hexanamido group, an α-(4-hydroxy-3-tert-butylphenoxy)-tetradecanamido group, a 2-oxo-pyrrolidin-1-yl group, a 2-oxo-5-tetradecylpyrrolidin-1-yl group, an N-methyltetradecanamido group, etc.), a sulfonamido group (for example, a methanesulfonamido group, a benzenesulfonamido group, an ethylsulfonamido group, a p-toluenesulfonamido group, an octanesulfonamido group, a p-dodecylbenzenesulfonamido group, an N-methyltetradecanesulfonamido group, etc.), a sulfamoyl group (for example, a sulfamoyl group, an N-methylsulfamoyl group, an N-ethylsulfamoyl group, an N,N-dimethylsulfamoyl group, an N,N-dihexylsulfamoyl group, an N-hexadecylsulfamoyl group, an N-[3-(dodecyloxy)propyl]-sulfamoyl group, an N-[4-(2,4-di-tert-amylphenoxy)butyl]-sulfamoyl group, an N-methyl-N-tetradecylsulfamoyl group, etc.), a carbamoyl group (for example, an N-methylcarbamoyl group, an N-butylcarbamoyl group, an N-octadecylcarbamoyl group, an N-[4-(2,4-di-tert-amylphenoxy)-butyl]carbamoyl group, an N-methyl-N-tetradecylcarbamoyl group, etc.), a diacylamino group (for example, an N-succinimido group, an N-phthalimido group, a 2,5-dioxo-1-oxazolidinyl group, a 3-dodecyl-2,5-dioxo-1-hydantoinyl group, a 3-(N-acetyl-N-dodecylamino)succinimido group, etc.), an alkoxycarbonyl group (for example, a methoxycarbonyl group, a tetradecyloxycarbonyl group, a benzyloxycarbonyl group, etc.), an alkoxysulfonyl group (for example, a methoxysulfonyl group, a butoxysulfonyl group, an octyloxysulfonyl group, a tetradecyloxysulfonyl group, etc.), an aryloxysulfonyl group (for example, a phenoxysulfonyl group, a p-methoxyphenoxysulfonyl group, a 2,4-di-tert-amylphenoxysulfonyl group, etc.), an alkanesulfonyl group (for example, a methanesulfonyl group, an ethanesulfonyl group, an octanesulfonyl group, a 2-ethylhexylsulfonyl group, a hexadecanesulfonyl group, etc.), an arylsulfonyl group (for example, a benzenesulfonyl group, a 4-nonylbenzenesulfonyl group, etc.), an alkylthio group (for example, a methylthio group, an ethylthio group, a hexylthio group, a benzylthio group, a tetradecylthio group, a 2-(2,4-di-tert-amylphenoxy)-ethylthio group, etc.), an arylthio group (for example, a phenylthio group, a p-tolylthio group, etc.), an alkoxycarbonylamino group (for example, a methoxycarbonylamino group, an ethoxycarbonylamino group, a benzyloxycarbonylamino group, a hexadecyloxycarbonylamino group, etc.), an alkylureido group (for example, an N-methylureido group, an N,N-dimethylureido group, an N-methyl-N-dodecylureido group, an N-hexadecylureido group, an N,N-dioctadecylureido group, etc.), an acyl group (for example, an acetyl group, a benzoyl group, an octadecanoyl group, a p-dodecanamidobenzoyl group, etc.), a nitro group, a carboxy group, a sulfo group, a hydroxy group, a trichloromethyl group, and the like.

In the above-described substituents, the alkyl moiety represents preferably an alkyl group having from 1 to 36 carbon atoms and the aryl moiety represents preferably an aryl group having from 6 to 38 carbon atoms.

Examples of the non-color forming ethylenic monomer which does not couple with the oxidation product of an aromatic primary amine developing agent include acrylic acid, α-chloroacrylic acid, an α-alkylacrylic acid (for example, methacrylic acid), an ester and an amide derived from an acrylic acid such as acrylic acid, methacrylic acid or etc. (for example, acrylamide, methacrylamide, tert-butylacrylamide, methyl acrylate, methyl methacrylate, ethyl acrylate, n-propyl acrylate, isopropyl acrylate, n-butyl acrylate, tert-butyl acrylate, n-butyl methacrylate, 2-ethylhexyl acrylate, n-hexyl acrylate, n-octyl acrylate, lauryl acrylate, methylenebisacrylamide, etc.), a vinyl ester (for example, vinyl acetate, vinyl propionate, vinyl laurate, etc.), acrylonitrile, methacrylonitrile, an aromatic vinyl compound (for example, styrene and a derivative thereof, vinyl toluene, divinyl benzene, vinyl acetophenone, sulfostyrene, etc.), itaconic acid, citraconic acid, crotonic acid, vinylidene chloride, a vinyl alkyl ether (for example, vinyl ethyl ether, etc.), an ester of maleic acid, N-vinyl-2-pyrrolidone, N-vinylpyrridine, 2- or 4-vinylpyridine, etc.

Of these monomers, an ester of acrylic acid, an ester of methacrylic acid, an ester of maleic acid are particularly preferred.

Two or more non-color forming ethylenically unsaturated monomers described above can be used together. For example, a combination of n-butyl acrylate and divinyl benzene, styrene and methacrylic acid, n-butyl acrylate and methacrylic acid, etc., can be used.

The ethylenically unsaturated monomer which is used to copolymerize with the monomer coupler represented by the above-described general formula (I) can be selected so that the copolymer to be formed possesses good physical properties and/or chemical properties, for example, solubility, compatibility with a binder such as gelatin in a photographic colloid composition, flexibility, heat stability, etc., as well known in the field of polymer color couplers.

The magenta polymer coupler latex used in the present invention can be prepared by an emulsion polymerization method as described above, or by dissolving a hydrophobic polymer coupler obtained by polymerization of a monomer coupler in an organic solvent and then dispersing the solution in a latex form in an aqueous gelatin solution. With respect to the emulsion polymerization, the methods as described in U.S. Pat. Nos. 4,080,211 and 3,370,952 and with respect to the method in which a hydrophobic polymer coupler is dispersed in a latex form in an aqueous gelatin solution, the method as described in U.S. Pat. No. 3,451,820 can be employed, respectively. These methods can be applied to preparation of homopolymers and preparation of copolymers. In the latter case, a non-color forming monomer is preferably a liquid monomer which may act, in the case of the emulsion polymerization, as a solvent for a monomer which is normally solid.

Free radical polymerization of an ethylenically unsaturated solid monomer is initiated with the addition to the monomer molecule of a free radical which is formed by thermal decomposition of a chemical initiator, an action of a reducing agent to an oxidative compound (a redox initiator) or a physical action, for example, irradiation of ultraviolet rays or other high energy radiations, high frequencies, etc.

Examples of the chemical initiators commonly used include a water-soluble initiator, for example, a persulfate (such as ammonium persulfate, potassium persulfate, etc.), hydrogen peroxide, 4,4'-azibis(4-cyanovaleirc acid), etc., and a water-insoluble initiator, for example, azoisobutyronitrile (such as 2,2'-azobis(2,4-dimethylvaleronitrile), 2,2'-azobisisobutyronitrile, etc.), benzoyl peroxide, chlorobenzoyl peroxide, and other compounds. Examples of the redox initiators usually used include hydrogen peroxide-iron (II) salt, potassium persulfate-potassium hydrogensulfate, cerium salt-alcohol, etc. Specific examples and functions of the initiators are described in F. A. Bovey, *Emulsion Polymerization,* pages 59–93, (Interscience Publisher Inc., New York (1955)).

As an emulsifier which can be used in the emulsion polymerization, a compound having surface activity is used. Preferred examples include soap, a sulfonate, a sulfate, a cationic compound, an amphoteric compound and a high molecular weight protective colloid. Specific examples and functions of the emulsifiers are described in *Belgische Chemische Industrie,* Vol. 28, pages 16–20 (1963).

On the other hand, an organic solvent which is used for dissolving a hydrophobic polymer coupler in the case where the hydrophobic polymer coupler is dispersed in a latex form in an aqueous gelatin solution is removed from the mixture before coating of the dispersion solution or by vaporization during drying of the dispersion solution coated, although the latter is less preferable. With respect to removing the solvent, a method in which the solvent is removed by washing a gelatin noodle with water is applied when the solvent is water-soluble to some extent, or a spray drying method, a vacuum purging method or a steam purging method can be employed for removing the solvent.

Examples of the organic solvents which can be removed include, for example, an ester (for example, a lower alkyl ester, etc.) a lower alkyl ether, ketone, halogenated hydrocarbon (for example, methylene chloride, trichoroethylene, a fluorinated hydrocarbon, etc.), an alcohol (for example, an alcohol between n-butyl alcohol and octyl alcohol, etc.), and a mixture thereof.

Any type of dispersing agent can be used in the dispersion of the hydrophobic polymer coupler. Ionic surface active agents, and particularly anionic surface active agents are preferred. Amphoteric surface active agents such as C-cetyl betaine, an N-alkylaminopropionate, an N-alkyliminodipropionate, etc., can also be used.

In order to increase the dispersion stability, control the color hue of a dye formed from a polymer coupler latex dispersed and the oxidation product of an aromatic primary amine developing agent and improve the bending property of the emulsion coated, a permanent solvent, that is, a water-immiscible organic solvent having a high boiling point (i.e., above 200° C.), may be added. The concentration of the permanent solvent must be at such a low level that the copolymer is plasticized while it is maintained in solid particle form. Furthermore, it is desirable to use the permanent solvent in a relatively low concentration in order to reduce the thickness of a final emulsion layer as much as possible to obtain good sharpness.

It is desirable if the ratio of the color forming portion in the polymer coupler latex is usually from 5 to 80% by weight. Particularly, a ratio from 20 to 70% by weight is preferred in view of color reproducibility, color forming property and stability. In this case, an equivalent molecular weight, that is, a gram number of the polymer containing 1 mol of a monomer coupler, is preferably from about 250 to 3,000, but it is not limited thereto.

Since in the polymer coupler latex according to the present invention the color forming portion is connected to the polymer chain through the portion of coupling releasable group, it is possible to only diffuse the dyes formed by controlling the diffusibility of the portion which forms the dye upon color development (for example, by introducing an oil-solubilizing group). Therefore, when the polymer coupler latex according to the present invention is used, the sharpness of images obtained can be improved. It is also possible to produce a diffusion transfer material.

Preferred specific examples of the monomer couplers used in the present invention are set forth below, but the present invention is not to be construed as being limited thereto.

(1)

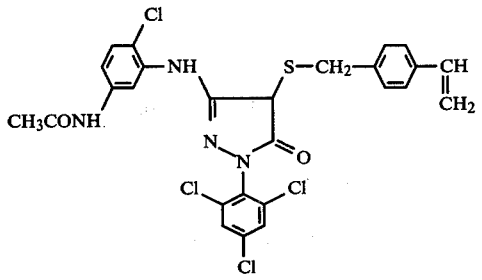

(2)

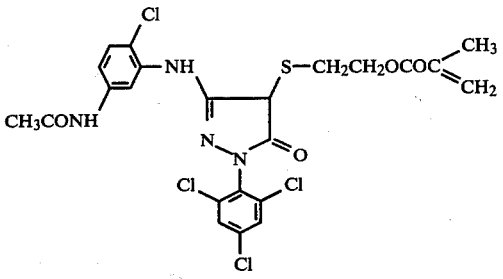

(3)

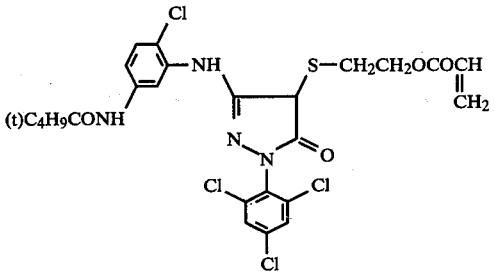

(4)

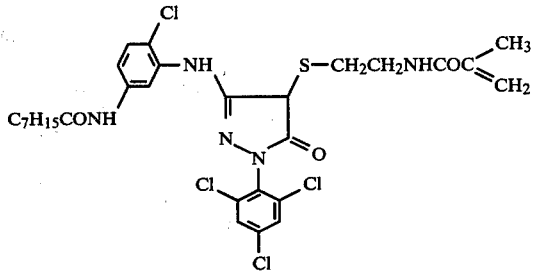

(5)

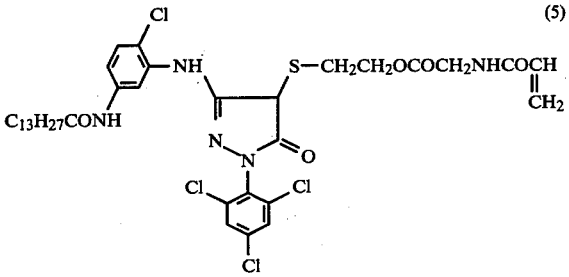

-continued (6)

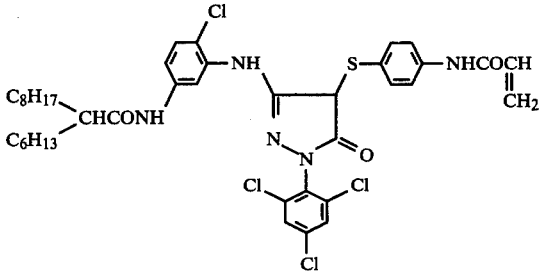

(7)

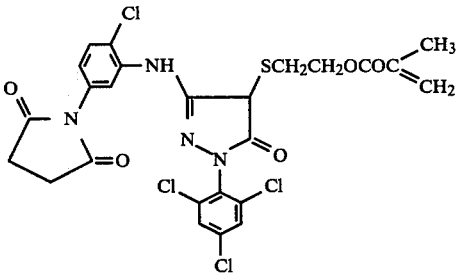

(8)

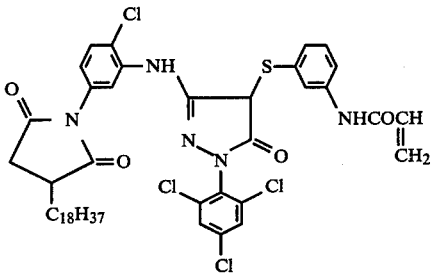

(9)

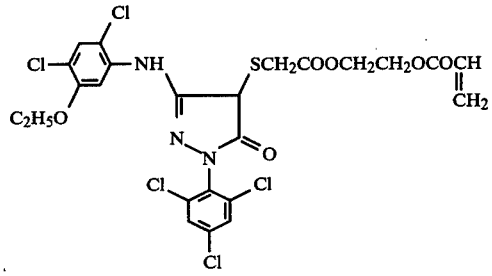

(10)

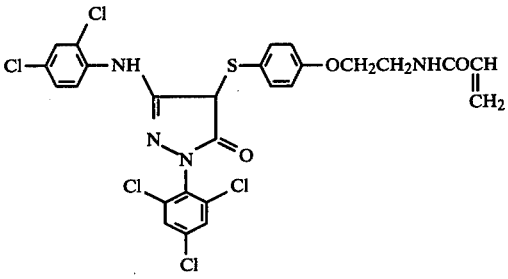

-continued
(11)
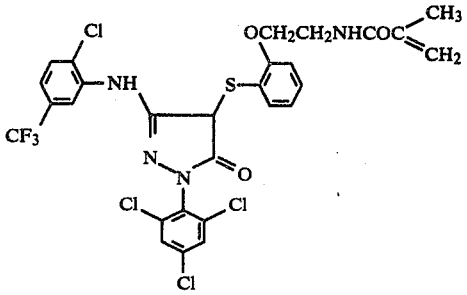
(12)
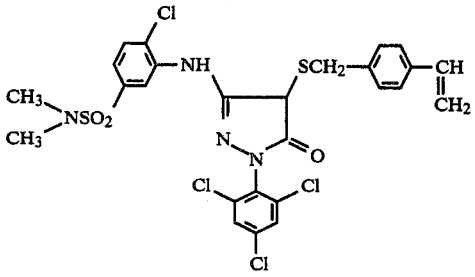
(13)
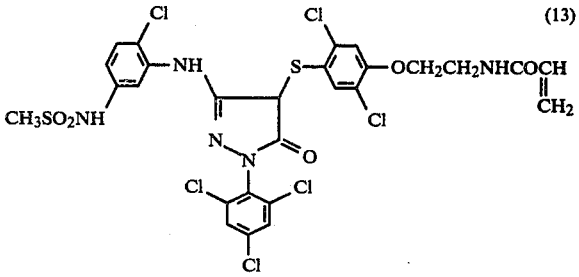
(14)
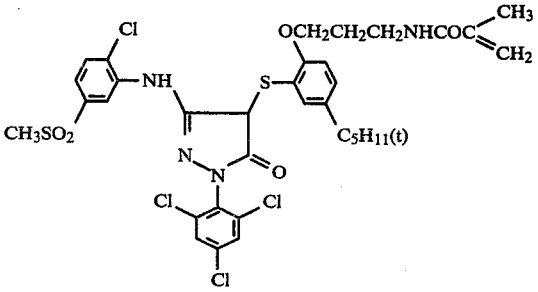
(15)
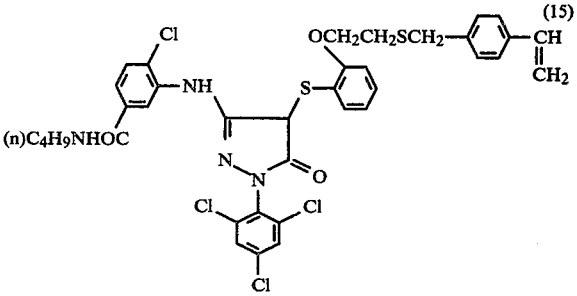
-continued
(16)
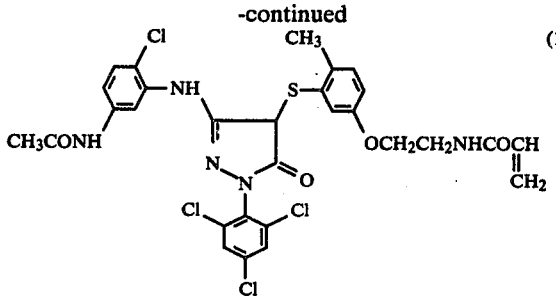
(17)
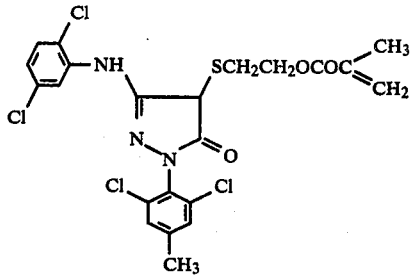
(18)
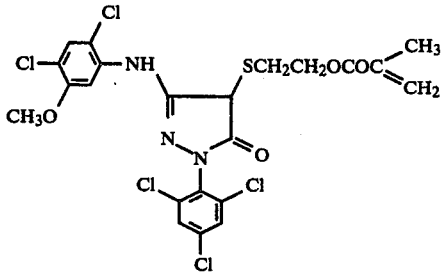
(19)
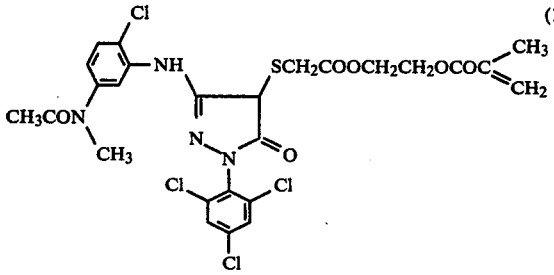
(20)
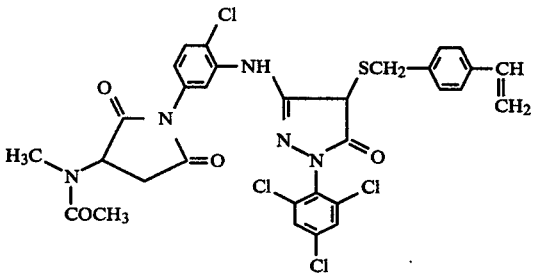
(21)
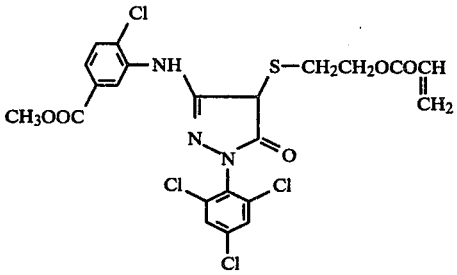

-continued
(22)
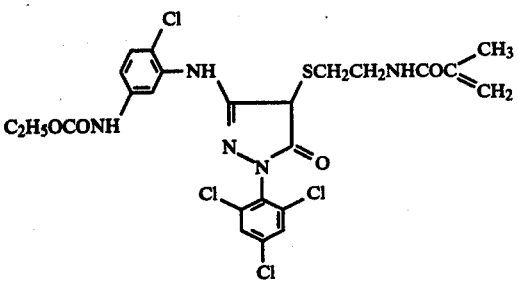
(23)
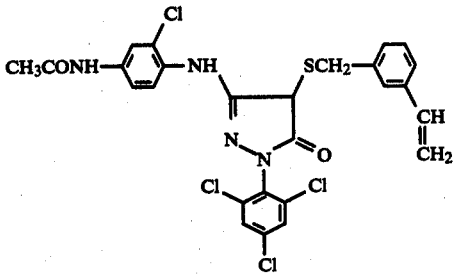
(24)
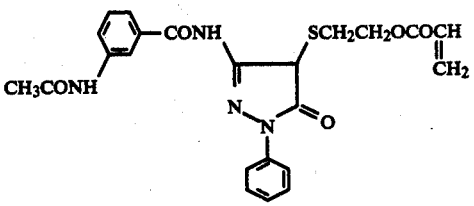
(25)
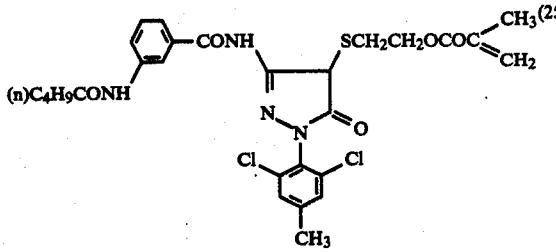
(26)
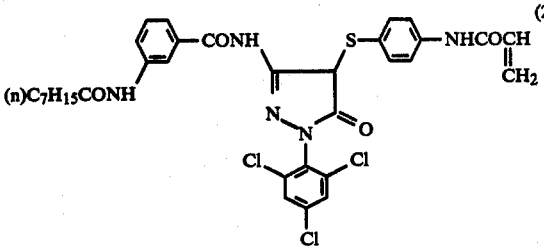
(27)
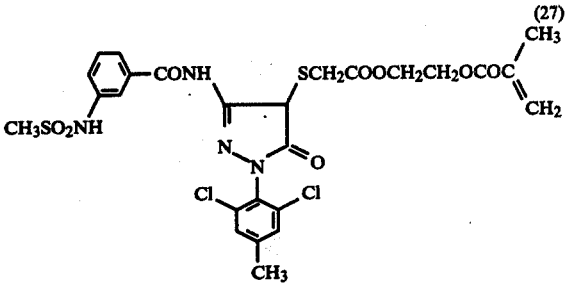
-continued
(28)
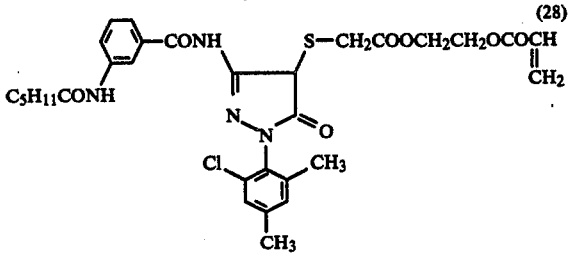
(29)
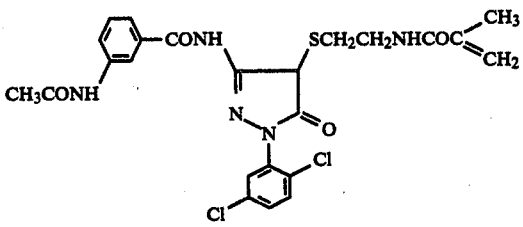
(30)
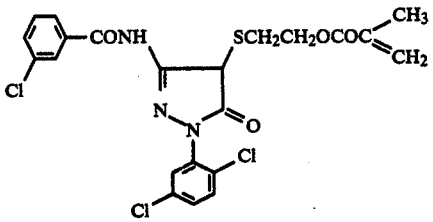
(31)
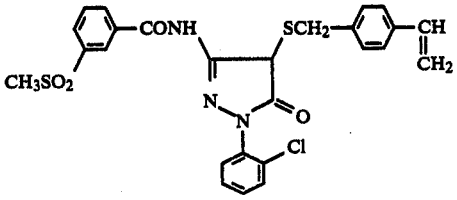
(32)
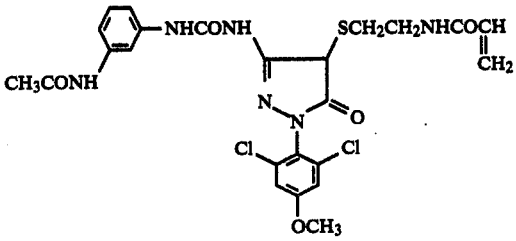
(33)
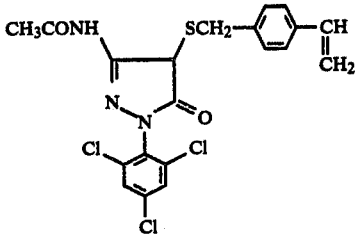
(34)
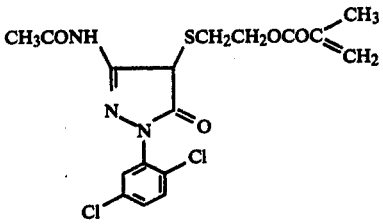

-continued (35)

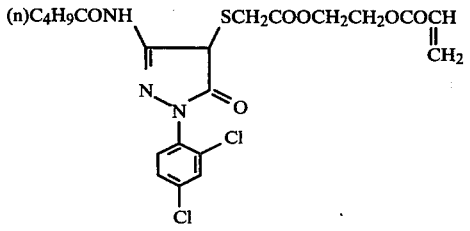

(36)

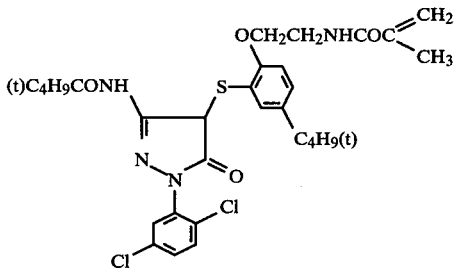

(37)

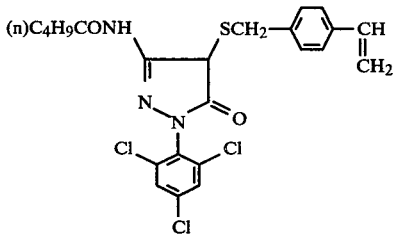

(38)

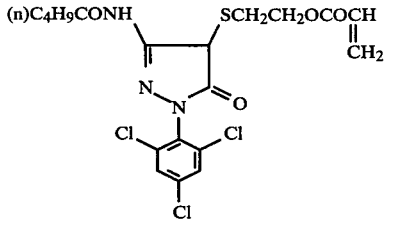

(39)

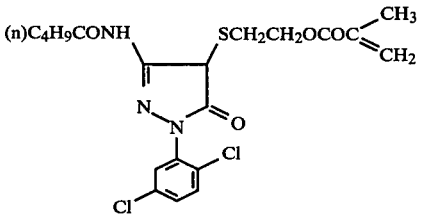

The monomer couplers used in the present invention can be synthesized in accordance with the methods as described in Japanese Patent Application (OPI) Nos. 25056/80, 29805/80 and 62454/80 (the term "OPI" as used herein refers to a "published unexamined Japanese patent application"), U.S. Pat. No. 4,351,897, etc.

More specifically, compounds in which a coupling releasable group is a thiophenol derivative can be synthesized according to the following methods.

1. A thiophenol derivative or a corresponding disulfide is converted into a sulphenyl halide by treatment with a halogenating agent (for example, chlorine, bromine, sulfuryl chloride, N-bromosuccinimide, etc.), and then the sulphenyl halide is reacted with a 4-equivalent coupler in the presence of a basic catalyst, or in the absence of a catalyst, to introduce the arylthio group to the coupling active position of the coupler as set forth in Reaction Scheme I below. This method can also be conducted by the addition of a halogen to a mixture of a thiophenol derivative and a 4-equivalent coupler.

Reaction Scheme I

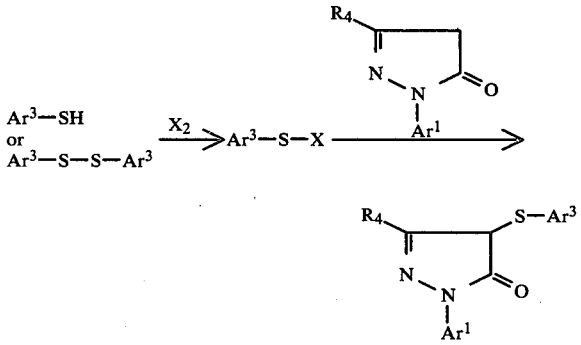

2. After the active position of a 4-equivalent coupler is treated with a halogenating agent and the resulting halogen substituted compound is reacted with a thiophenol derivative in the presence of a basic catalyst, or in the absence of a catalyst, to introduce the arylthio group to the coupling active position of the coupler as set forth in Reaction Scheme II below. This method can be applied to a 4-equivalent coupler having an anilino group at the 3-position of the pyrazolone ring. In such a case, after the amino group is protected by acylation (for example, an acetyl group, an ethoxycarbonyl group, etc.), the arylthio group is introduced in the same manner as described above and then the protective group is removed to obtain the desired coupler.

Reaction Scheme II

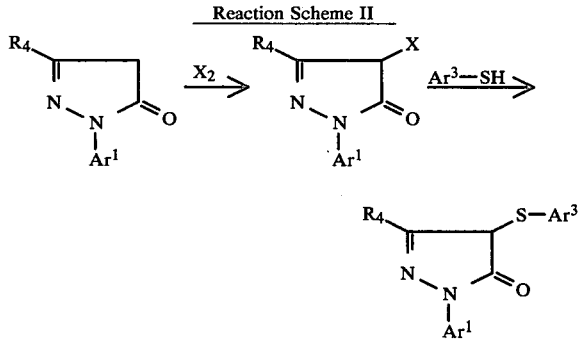

Case of 3-anilino group:

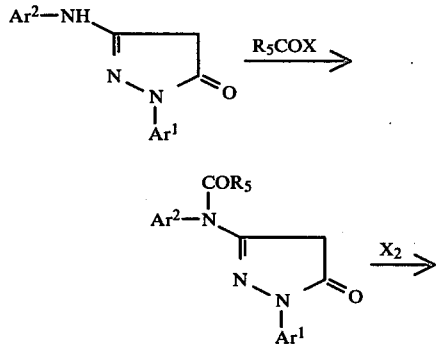

-continued

Reaction Scheme II

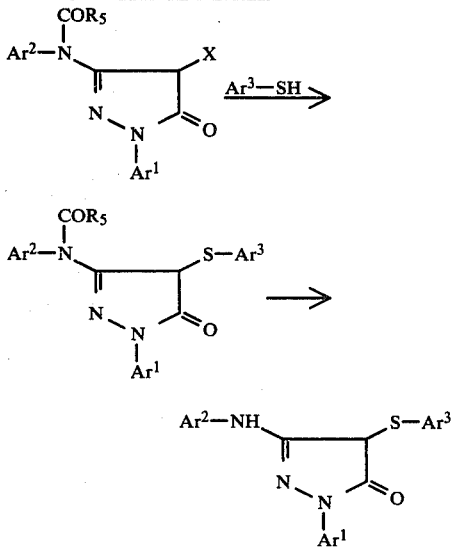

The thiophenol derivative or the corresponding disulfide, which is the source of the coupling releasable group, can be synthesized according to the following methods.

A corresponding aniline derivative is reacted with sodium nitrite under an acidic condition to form the diazonium salt, and then the latter is reacted with sodium sulfide or sodium disulfide to obtain a thiophenol derivative or a corresponding disulfide, respectively, as set forth in Reaction Scheme III below.

Reaction Scheme III

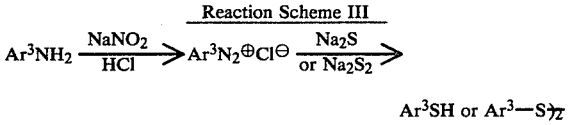

A benzene derivative including a substituent suited for the purpose of the present invention is chlorosulfonated with chlorosulfonic acid, and then the resulting compound is reduced using metallic zinc or metallic tin together with an acid, to obtain a thiophenol derivative as set forth in Reaction Scheme IV below.

Reaction Scheme IV

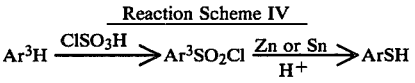

This method is applicable to a sulfonyl chloride which is produced by reaction of a corresponding sulfonic acid with thionyl chloride, phosphorus oxychloride, etc., when an appropriate sulfonic acid is available as a starting material. Also, it is possible to obtain a corresponding disulfide using hydrogen iodide as a reducing agent.

After converting a corresponding phenol derivative to a sodium salt, the latter is reacted with dimethylthiocarbamoyl chloride to form a dimethylthiocarbamate, and the resulting compound is subjected to heat rearrangement and hydrolysis through a dimethyl thiolcarbamate to obtain a thiophenol derivative as set forth in Reaction Scheme V below. This method is described in *J. Org. Chem.*, Vol. 31, p. 3980 (1956).

Reaction Scheme V

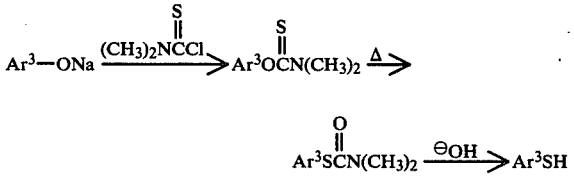

Further, compounds in which a coupling releasable group is an alkylthio derivative can be synthesized according to the following methods.

1. An S-alkylisothiourea derivative hydrochloride is reacted with a 4-equivalent coupler to introduce the alkylthio group to the coupling active position of the coupler as set forth in Reaction Scheme VI below.

Reaction Scheme VI

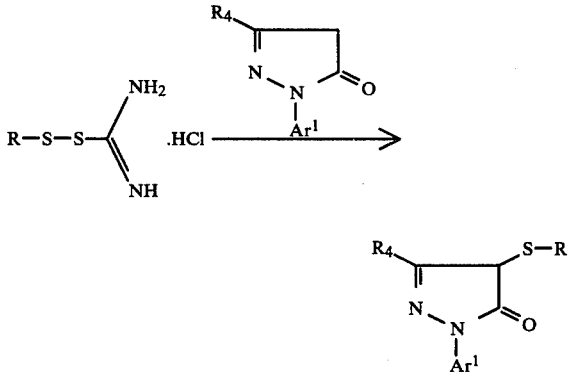

2. A magenta coupler having a halogen atom at the coupling position is reacted with thiourea and then the resulting isothiuronium salt is reacted with an alkyl halide derivative in the presence of a base to introduce the alkylthio group to the coupling active position of the coupler as set forth in Reaction Scheme VII below. This method can also be conducted by the addition of a halogen to a mixture of a 4-equivalent coupler and thiourea to prepare an isothiuronium salt.

Reaction Scheme VII

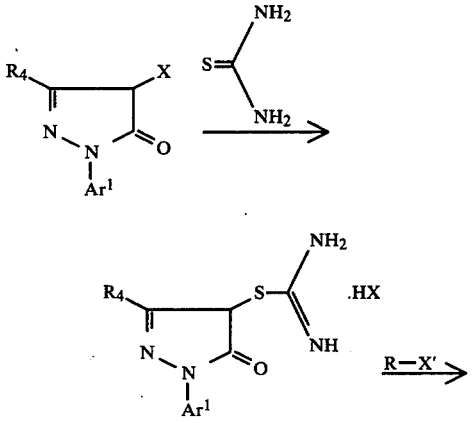

-continued

Reaction Scheme VII

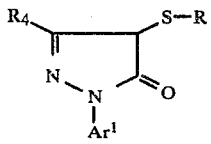

The introduction of a polymerizable functional group (i.e., an ethylene group) to the portion of coupling releasable group can be carried out either before or after the introduction of the coupling releasable group to a 4-equivalent coupler.

Synthesis examples of the representative couplers according to the present invention are set forth below, but the present invention should not be construed as being limited thereto.

A. MONOMER COMPOUNDS

Synthesis Example 1

Synthesis of 1-(2,4,6-trichlorophenyl)-3-(2-chloro-5-acetamidoanilino)-4-(4-vinylbenzylthio)-5-oxo-2-pyrazoline [Monomer Coupler (1)]

89 g (0.2 mol) of 1-(2,4,6-trichlorophenyl)-3-(2-chloro-5-acetamidoanilino)-5-oxo-2-pyrazoline and 16 g (0.21 mol) of thiourea were dissolved in 200 ml of dimethylformamide. 38.4 g (0.24 mol) of bromine was added dropwise to the solution with stirring over a period of about 30 minutes at from 20° C. to 30° C. and the mixture was further stirred for 1 hour. The reaction solution was poured into 3 liters of water, the solid thus-deposited was collected by filtration and dried to obtain 102.3 g of the isothiuronium salt (hydrobromide).

90 g (0.15 mol) of the isothiuronium salt thus-obtained was dissolved in 150 ml of dimethylacetamide. To the solution was added a solution containing 42 g (0.75 mol) of potassium hydroxide dissolved in 80 ml of methanol while introducing a nitrogen gas therein. After stirred for 3 hours at room temperature, 5 ml of nitrobenzene and 27.5 g (0.18 mol) of p-chloromethylstyrene were gradually added while cooling with water and then 3 g of potassium iodide was added. After further stirring for 3.5 hours, the mixture was neutralized with 25 ml of acetic acid, 1 liter of water was added thereto and extracted with ethyl acetate. The extract was washed with water and dried with anhydrous sodium sulfate. The ethyl acetate was distilled off under a reduced pressure and to the residue was added acetonitrile. The crystals thus-deposited were collected by filtration and recrystallized from a solvent mixture of acetonitrile and ethanol (3:1 by volume) to obtain 57.4 g (66.6% yield) of Monomer Coupler (1) having a melting point of 240° C.

Synthesis Example 2

Synthesis of 1-(2,4,6-trichlorophenyl)-3-acetylamino-4-(4-vinylbenzylthio)-5-oxo-2-pyrazoline [Monomer Coupler (33)]

64 g (0.2 mol) of 1-(2,4,6-trichlorophenyl)-3-acetylamino-5-oxo-2-pyrazoline and 16 g (0.21 mol) of thiourea were dissolved in 130 ml of dimethylformamide. 38.4 g (0.24 mol) of bromine was added dropwise to the solution with stirring over a period of about 30 minutes at about 25° C. and the mixture was further stirred for 1 hour. The reaction solution was poured into water and separated by adding ethyl acetate. The aqueous layer was neutralized by adding 50 g of sodium hydrogen carbonate and allowed to stand for 15 hours. The solid thus-deposited was collected by filtration and dried to obtain 53.5 g of the isothiuronium salt (carbonate).

45.5 g (0.1 mol) of the isothiuronium salt thus-obtained was dissolved in 100 ml of dimethylacetamide. To the solution was added a solution containing 28 g (0.5 mol) of potassium hydroxide dissolved in 60 ml of methanol while introducing a nitrogen gas therein. After stirring for 1.5 hours at room temperature, 5 ml of nitrobenzene and 18.3 g (0.12 mol) of p-chloromethylstyrene were gradually added while cooling with water and then 2 g of potassium iodide was added. After further stirring for 5 hours, the mixture was neutralized with 15 ml of acetic acid, 1 liter of water was added thereto and extracted with ethyl acetate. The extract was washed with water and dried with anhydrous sodium sulfate. The ethyl acetate was distilled off under a reduced pressure and the residue was separated and purified by a silica gel column chromatography to obtain 24.1 g (51.3% yield) of oily Monomer Coupler (33).

Synthesis Example 3

Synthesis of 1-(2,5-dichlorophenyl)-3-acetylamino-4-methacryloyloxyethylthio-5-oxo-2-pyrazoline [Monomer Coupler (34)]

57.2 g (0.2 mol) of 1-(2,5-dichlorophenyl)-3-acetylamino-5-oxo-2-pyrazoline and 16 g (0.21 mol) of thiourea were dissolved in 200 ml of dimethylformamide. 38.4 g (0.24 mol) of bromine was added dropwise to the solution with stirring over a period of about 30 minutes at 25° C. and the mixture was further stirred for 1 hour. The reaction solution was poured into 3 liters of water, the solid thus-deposited was collected by filtration and dried to obtain 69.1 g of the isothiuronium salt.

66.5 g (0.15 mol) of the isothiuronium salt thus-obtained was dissolved in 150 ml of dimethylacetamide. To the solution was added a solution containing 28 g (0.5 mol) of potassium hydroxide dissolved in 60 ml of methanol while introducing a nitrogen gas therein. After stirring for 3 hours at room temperature, 22.5 g (0.18 mol) of $\beta$-bromoethanol was added while cooling with water and then 2.5 g of potassium iodide was added. After further stirring for 5 hours, the mixture was neutralized with 15 ml of acetic acid, 1 liter of water was added thereto and extracted with ethyl acetate. The extract was washed with water and dried with anhydrous sodium sulfate. The ethyl acetate was distilled off under a reduced pressure and 29.7 g of the 4-hydroxyethylthio derivative was obtained as an oily product.

25.4 g (0.07 mol) of the hydroxyethylthio derivative thus-obtained was dissolved in 150 ml of tetrahydrofuran. To the solution were added 21.8 ml (0.28 mol) of pyridine and 1 ml of nitrobenzene and then to the mixture was added 18.3 g (0.175 mol) of methacrylic chloride with thoroughly stirring while cooling with ice. The mixture was stirred for 2 hours, to the solution was added water, and extracted with ethyl acetate. The extract was washed with water and dried with anhydrous sodium sulfate. The ethyl acetate was distilled off under a reduced pressure, the residue obtained was dissolved in 200 ml of ethanol, to which was added 5 ml of a 30% aqueous ammonia and stirred for 30 minutes. After neutralizing with acetic acid, 300 ml of water was added and extracted with ethyl acetate. The extract was washed with water and dried with anhydrous sodium sulfate. The ethyl acetate was distilled off under a reduced pressure, the residue was separated and purified by a silica gel column chromatography to obtain 13.0 g (43.3% yield) of oily Monomer Coupler (34).

B. POLYMER COMPOUNDS

Synthesis Method I

Synthesis Example 4

Copolymer latex of 1-(2,4,6-trichlorophenyl)-3-(2-chloro-5-acetamidoanilino)-4-(4-vinylbenzylthio)-5-oxo-2-pyrazoline [Monomer Coupler (1)] and n-butyl acrylate [Polymer Coupler Latex (A)]

2 liters of an aqueous solution containing 2 g of sodium salt of oleyl methyl tauride dissolved was stirred and heated to 95° C. while gradually introducing a nitrogen gas through the solution. To the mixture was added 40 ml of an aqueous solution containing 280 mg of potassium persulfate dissolved. 30 g of n-butyl acrylate and 10 g of Monomer Coupler (1) were dissolved by heating in 400 ml of ethanol and the resulting solution was added to the above-described aqueous solution at an interval of about 30 minutes while preventing the deposition of crystals. After the completion of the addition, the mixture was heated at from 85° C. to 95° C. with stirring for 45 minutes, to which was then added 40 ml of an aqueous solution containing 120 mg of potassium persulfate dissolved. After being reacted for 1 hour, the n-butyl acrylate not reacted were distilled off as an azeotropic mixture with water. The latex thus-formed was cooled, pH of which was adjusted to 6.0 with a 1 N sodium hydroxide solution and filtered. The concentration of the polymer in the latex was 11.35% and it was found that the copolymer synthesized contained 24.3% of Monomer Coupler (I) as the result of nitrogen analysis.

Synthesis Example 5

Copolymer latex of 1-(2,4,6-trichlorophenyl)-3-(2,4-dichloro-5-methoxyanilino)-4-methacryloyloxyethylthio-5-oxo-2-pyrazoline [Monomer Coupler (18)] and ethyl acrylate [Polymer Coupler Latex (B)]

2 liters of an aqueous solution containing 2 g of sodium salt of oleyl methyl tauride dissolved was stirred and heated to 95° C. while introducing a nitrogen gas through the solution. To the mixture was added 40 ml of an aqueous solution containing 280 mg of potassium persulfate dissolved. 30 g of ethyl acrylate and 10 g of Monomer Coupler (18) were dissolved by heating in 400 ml of ethanol and the resulting solution was added to the above-described aqueous solution at an interval of about 30 minutes while preventing the deposition of crystals. After the completion of the addition, the mixture was heated at from 85° C. to 95° C. with stirring for 45 minutes, to which was then added 40 ml of an aqueous solution containing 120 mg of potassium persulfate dissolved. After being reacted for 1 hour, the ethyl acrylate not reacted was distilled off as an azeotropic mixture with water. The latex thus-formed was cooled, pH of which was adjusted to 6.0 with a 1 N sodium hydroxide solution and filtered. The concentration of the polymer in the latex was 11.02% and it was found that the copolymer synthesized contained 27.8% of Monomer Coupler (18) as the result of nitrogen analysis.

Synthesis Example 6

Copolymer latex of 1-(2,5-dichlorophenyl)-3-acetylamino-4-methacryloyloxyethylthio-5-oxo-2-pyrazoline [Monomer Coupler (34)] and n-butyl acrylate [Polymer Coupler Latex (C)]

270 ml of an aqueous solution containing 1.54 g of sodium salt of oleyl methyl tauride dissolved was stirred and heated to 95° C. while introducing a nitrogen gas through the solution. To the mixture were added 20 ml of an aqueous solution containing 28 mg of potassium persulfate dissolved, and then 2.8 g of n-butyl acrylate. The mixture was polymerized by heating at from 85° C. to 90° C. with stirring for about 1 hour to prepare Latex (a). Then, to Latex (a) were added 10 g of Monomer Coupler (34), 100 ml of ethanol and 10 ml of an ethanol solution containing 18 g of n-butyl acrylate dissolved. To the mixture was then added 50 ml of an aqueous solution containing 196 mg of potassium persulfate dissolved and the mixture was polymerized by heating with stirring. After being reacting for 1 hour, 30 ml of an aqueous solution containing 84 mg of potassium persulfate was further added to the mixture and the mixture was continuously reacted for 1.5 hours. The ethanol and the n-butyl acrylate not reacted were distilled off as an azeotropic mixture with water. The latex thus-formed was cooled, pH of which was adjusted to 6.0 with a 1 N sodium hydroxide solution and filtered. The concentration of the polymer in the latex was 10.7% and it was found that the copolymer synthesized contained 33.5% of Monomer Coupler (34) as the result of nitrogen analysis.

Synthesis Method II

Synthesis Example 7

Synthesis of copolymer coupler of 1-(2,4,6-trichlorophenyl)-3-acetylamino-4-(4-vinylbenzylthio)-5-oxo-2-pyrazoline [Monomer Coupler (33)] and methyl acrylate [Hydrophobic Polymer Coupler (I)]

10 g of Monomer Coupler (33) and 30 g of methyl acrylate were added to 150 ml of dioxane and dissolved by heating at 85° C. To the solution was added 350 mg of 2,2'-azobis(2,4-dimethylvaleronitrile) dissolved in 10 ml of dioxane, the mixture was heated for about 3 hours and further heated at 95° C. for 2 hours. The resulting solution was then poured into 2 liters of ice water and the solid thus-deposited was collected by filtration and thoroughly washed with water. By drying the solid under a reduced pressure with heating, 38.4 g of Hydrophobic Polymer Coupler (I) was obtained. It was found that the hydrophobic polymer coupler contained 28.9% of Monomer Coupler (33) in the copolymer synthesized as the result of nitrogen analysis.

A method for dispersing Hydrophobic Polymer Coupler (I) in an aqueous gelatin solution in a form of latex is described in the following.

Synthesis of Polymer Coupler Latex (I')

Two solutions (a) and (b) were prepared in the following manner.

Solution (a): 300 g of a 5.0% by weight aqueous solution of bone gelatin (pH of 5.6 at 35° C.) was heated to 32° C. and to which was added 12 ml of a 10% by weight aqueous solution of sodium lauryl sulfate.

Solution (b): 30 g of the hydrophobic polymer coupler described above was dissolved in 60 g of ethyl acetate at 38° C.

Solution (b) was put into a mixer with explosion preventing equipment while stirring at a high speed to which was rapidly added Solution (a). After stirring for 1 minute, the mixer was stopped and ethyl acetate was removed by distillation under a reduced pressure. Thus, the hydrophobic polymer coupler was dispersed in a diluted gelatin solution to prepare Polymer Coupler Latex (I').

Synthesis Example 8

Synthesis of copolymer coupler of 1-(2,5-dichlorophenyl)-3-(3-acetamidobenzamido)-4-methacryloylaminoethylthio-5-oxo-2-pyrazoline [Monomer Coupler (29)] and n-octyl acrylate [Hydrophobic Polymer Coupler (II)]

20 g of Monomer Coupler (29) and 20 g of n-octyl acrylate were added to 150 ml of tertiary butanol and the mixture was refluxed by heating with stirring. To the mixture was added 350 mg of azobisisobutyronitrile dissolved in 10 ml of tertiary butanol and the mixture was further refluxed by heating for about 3 hours. The resulting solution was then poured into 2 liters of ice water and the solid thus-deposited was collected by filtration and thoroughly washed with water. The solid was dissolved in ethyl acetate and reprecipitated with n-hexane. By drying the solid under a reduced pressure with heating, 37.6 g of Hydrophobic Polymer Coupler (II) was obtained. It was found that the hydrophobic polymer coupler contained 48.6% of Monomer Coupler (29) in the copolymer synthesized as the result of nitrogen analysis.

Synthesis of Polymer Coupler Latex (II')

Two solutions (a) and (b) were prepared in the following manner.

Solution (a): 200 g of a 3.0% by weight aqueous solution of bone gelatin (pH of 5.6 at 35° C.) was heated to 38° C. and to which was added 16 ml of a 10.0% by weight aqueous solution of sodium lauryl sulfate.

Solution (b): 20 g of Hydrophobic Polymer Coupler (II) described above was dissolved in 200 ml of ethyl acetate at 38° C.

Solution (b) was put into a mixer with explosion preventing equipment while stirring at high speed and to which was rapidly added Solution (a). After stirring for 1 minute, the mixer was stopped and ethyl acetate was removed by distillation under a reduced pressure. Thus, the hydrophobic polymer coupler was dispersed in a diluted gelatin solution to prepare Polymer Coupler Latex (II').

Synthesis Examples 9 to 28

Using the above-described monomer couplers, the magenta copolymer coupler latexes described below were prepared in the same manner as described for the copolymers in Synthesis Examples 4 to 6 (Synthesis Method I).

Polymer Coupler Latexes by Synthesis Method I

| Synthesis Example | Polymer Coupler Latex | Monomer Coupler | Amount (g) | Monomer(*1) | Amount (g) | Monomer Coupler Unit in Polymer (wt %) |
|---|---|---|---|---|---|---|
| 9 | (D) | (1) | 10 | BA | 40 | 19.4 |
| 10 | (E) | (1) | 10 | MA | 40 | 22.7 |
| 11 | (F) | (2) | 10 | BA | 40 | 19.7 |
| 12 | (G) | (2) | 10 | BA/MAA | 37.5/2.5 | 19.9 |
| 13 | (H) | (3) | 10 | EA | 20 | 35.2 |
| 14 | (I) | (5) | 20 | MA | 20 | 53.7 |
| 15 | (J) | (7) | 10 | BA | 40 | 18.7 |
| 16 | (K) | (10) | 10 | BMA | 20 | 32.8 |
| 17 | (L) | (14) | 10 | BA | 40 | 20.2 |
| 18 | (M) | (16) | 10 | BA | 40 | 20.7 |
| 19 | (N) | (17) | 20 | OA | 20 | 49.3 |
| 20 | (O) | (18) | 10 | BA | 40 | 19.1 |
| 21 | (P) | (18) | 20 | EHA | 20 | 47.4 |
| 22 | (Q) | (19) | 10 | BA | 40 | 18.6 |
| 23 | (R) | (19) | 20 | ST | 10 | 65.5 |
| 24 | (S) | (24) | 15 | BA | 35 | 30.4 |
| 25 | (T) | (28) | 15 | EA | 35 | 30.7 |
| 26 | (U) | (33) | 10 | BA | 40 | 18.7 |
| 27 | (V) | (34) | 15 | BA | 35 | 29.8 |
| 28 | (W) | (37) | 10 | BA | 40 | 19.2 |

(*1)MA: Methyl Acrylate
BMA: n-Butyl Methacrylate
EA: Ethyl Acrylate
OA: n-Octyl Acrylate
PA: n-Propyl Acrylate
EHA: 2-Ethylhexyl Acrylate
BA: n-Butyl Acrylate
ST: Styrene
MAA: Methacrylic Acid The amounts of the monomer couplers and the monomers in the above table indicate amounts used in the synthesis of the polymer coupler latexes.

Synthesis Examples 29 to 45

Using the above-described monomer couplers, the hydrophobic magenta polymer couplers described below were prepared in the same manner as described for the copolymers in Synthesis Examples 7 and 8 (Synthesis Method II).

Hydrophobic Polymer Coupler by Synthesis Method II

| Synthesis Example | Hydrophobic Polymer Coupler | Monomer Coupler | Amount (g) | Monomer(*1) | Amount (g) | Monomer Coupler Unit in Polymer (wt %) |
|---|---|---|---|---|---|---|
| 29 | (III) | (1) | 10 | BA | 40 | 18.3 |
| 30 | (IV) | (2) | 15 | BA/AA | 32.5/2.5 | 28.9 |
| 31 | (V) | (7) | 20 | MA | 20 | 55.3 |
| 32 | (VI) | (10) | 10 | BA | 40 | 18.5 |
| 33 | (VII) | (18) | 20 | EHA | 20 | 49.4 |
| 34 | (VIII) | (24) | 15 | EA | 35 | 28.7 |
| 35 | (IX) | (26) | 20 | PA | 20 | 50.3 |
| 36 | (X) | (28) | 15 | EA | 35 | 31.6 |
| 37 | (XI) | (29) | 15 | EA | 35 | 30.1 |
| 38 | (XII) | (30) | 15 | OA | 35 | 29.8 |
| 39 | (XIII) | (32) | 20 | EMA | 20 | 32.3 |
| 40 | (XIV) | (33) | 15 | BA | 35 | 29.7 |
| 41 | (XV) | (34) | 15 | BA | 35 | 30.5 |
| 42 | (XVI) | (36) | 15 | BA | 35 | 30.9 |
| 43 | (XVII) | (38) | 10 | BA | 40 | 19.0 |
| 44 | (XVIII) | (39) | 20 | HA | 20 | 49.7 |

-continued

Hydrophobic Polymer Coupler by Synthesis Method II

| Synthesis Example | Hydrophobic Polymer Coupler | Monomer Coupler | Amount (g) | Monomer(*1) | Amount (g) | Monomer Coupler Unit in Polymer (wt %) |
|---|---|---|---|---|---|---|
| 45 | (XIX) | (39) | 15 | BA | 35 | 29.6 |

(*1)MA: Methyl Acrylate
HA: n-Hexyl Acrylate
EMA: Ethyl Methacrylate
OA: n-Octyl Acrylate
PA: n-Propyl Acrylate
EHA: 2-Ethylhexyl Acrylate
BA: n-Butyl Acrylate
AA: Acrylic Acid The amounts of the monomer couplers and the comonomers in the above table indicate amounts used in the synthesis of the polymer coupler latexes.

Dispersion of these hydrophobic polymer couplers can be carried out in the same manner as described in Synthesis Examples 7 and 8 and specific methods are described in the examples hereinafter.

The 2-equivalent magenta polymer coupler latexes according to the present invention can be used individually or as mixtures of two or more thereof.

The 2-equivalent magenta polymer coupler latexes according to the present invention can also be used together with a 4-equivalent magenta polymer coupler latex, such as those described in U.S. Pat. No. 4,080,211, British Pat. No. 1,247,688, etc.

Further, a dispersion which is prepared by dispersing a hydrophobic magenta color forming coupler, for example, a magenta coupler, as described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. No. 1,810,464, West German Patent Application (OLS) Nos. 2,408,665, 2,417,945, 2,418,959 and 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76 and 55122/78, etc., in a hydrophilic colloid in a manner as described, for example, in U.S. Pat. Nos. 2,269,158, 2,272,191, 2,304,940, 2,311,020, 2,322,027, 2,360,289, 2,772,163, 2,801,170, 2,801,171 and 3,619,195, British Pat. No. 1,151,590, West German Pat. No. 1,143,707, etc., is loaded into the 2-equivalent magenta polymer coupler latex according to the present invention in a manner as described in Japanese Patent Application (OPI) No. 39853/76, etc., and the resulting latex can be used. It is also possible for the above-described hydrophobic magenta coupler to be loaded into the 2-equivalent magenta polymer coupler latex according to the present invention in a manner as described in Japanese Patent Application (OPI) Nos. 59942/76 and 32552/79, U.S. Pat. No. 4,199,363, etc., and the resulting latex can be used. The term "load" used herein refers to the state in which a hydrophobic magenta coupler is incorporated into the interior of a 2-equivalent magenta polymer coupler latex, or a state in which a hydrophobic magenta coupler is deposited on the surface of a 2-equivalent magenta polymer coupler latex. However, the mechanism by which the load occurs is not accurately known.

In order to satisfy the characteristics required of the photographic light-sensitive material, a dispersion which is prepared by dispersing a development inhibitor releasing (DIR) coupler as described, for example, in U.S. Pat. Nos. 3,148,062, 3,227,554, 3,733,201, 3,617,291, 3,703,375, 3,615,506, 3,265,506, 3,620,745, 3,632,345, 3,869,291, 3,642,485, 3,770,436 and 3,808,945, British Pat. Nos. 1,201,110 and 1,236,767, etc., in a hydrophilic colloid in a manner as described in U.S. Pat. Nos. 2,269,158, 2,272,191, 2,304,940, 2,311,020, 2,322,027, 2,360,289, 2,772,163, 2,801,170, 2,801,171 and 3,619,195, British Pat. Nos. 1,151,590, West German Pat. No. 1,143,707, etc., is loaded into the 2-equivalent magenta polymer coupler latex according to the present invention in a manner as described in Japanese Patent Application (OPI) No. 39853/76. The resulting latex can then be used, or the above-described DIR coupler is loaded into the 2-equivalent magenta polymer coupler latex in a manner as described in Japanese Patent Application (OPI) Nos. 59942/76 and 32552/79, U.S. Pat. No. 4,199,363, etc., and the resulting latex can then be used.

Furthermore, the 2-equivalent magenta polymer coupler latex according to the present invention can be used together with a DIR compound as described, for example, in West German Patent Application (OLS) Nos. 2,529,350, 2,448,063 and 2,610,546, U.S. Pat. Nos. 3,928,041, 2,958,993, 3,961,959, 4,049,455, 4,052,213, 3,379,529, 3,043,690, 3,364,022, 3,297,445 and 3,287,129.

Moreover, the 2-equivalent magenta polymer coupler latex according to the present invention can be used in combination with a colored magenta coupler as described, for example, in U.S. Pat. No. 2,449,966, West German Pat. No. 2,024,186, Japanese Patent Application (OPI) Nos. 123625/74, 131448/74 and 42121/77, etc., a competing coupler as described, for example, in U.S. Pat. Nos. 3,876,428, 3,580,722, 2,998,314, 2,808,329, 2,742,832 and 2,689,793, etc., a stain preventing agent as described, for ecample, in U.S. Pat. Nos. 2,336,327, 2,728,659, 2,336,327, 2,403,721, 2,701,197 and 3,700,453, etc., a dye image stabilizing agent as described, for example, in British Pat. No. 1,326,889, U.S. Pat. Nos. 3,432,300, 3,698,909, 3,574,627, 3,573,050 and 3,764,337, etc., or the like.

The color photographic light-sensitive material produced according to the present invention can also contain conventional coupler(s) other than a magenta color forming coupler. A non-diffusible coupler which contains a hydrophobic group, called a ballast group, in the molecule thereof is preferred as a coupler. A coupler can have either a 4-equivalent or a 2-equivalent property with respect to the silver ion. In addition, a colored coupler providing a color correction effect, or a coupler which releases a development inhibitor upon development can also be present therein. Furthermore, a coupler which provides a colorless product upon coupling can be employed.

A known open chain ketomethylene type coupler can be used as a yellow color forming coupler. Of these couplers, benzoyl acetanilide type and pivaloyl acetanilide type compounds are especially effective. Specific examples of yellow color forming couplers which can be employed are described, for example, in U.S. Pat. Nos. 2,875,057, 3,265,506, 3,408,194, 3,551,155, 3,582,322, 3,725,072 and 3,891,445, West German Pat. No. 1,547,868, West German Patent Application (OLS) Nos. 2,219,917, 2,261,361 and 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76 and 87650/75, etc.

A phenol type compound, a naphthol type compound, etc., can be employed as a cyan color forming coupler. Specific examples of cyan color forming couplers which can be employed are those described, for example, in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, West German Patent Application (OLS) Nos. 2,414,830 and 2,454,329, Japanese Patent Application (OPI) Nos. 59838/73, 26034/76, 5055/73, 146828/76, 73050/80, etc.

Two or more kinds of the couplers described above can be incorporated into the same layer, or the same coupler compound can also be present in two or more layers.

A known method, for example, the method described in U.S. Pat. No. 2,322,027, can be used in order to incorporate the couplers described above into a silver halide emulsion layer. The coupler is dispersed in a hydrophilic colloid and then mixed with a silver halide emulsion. When a coupler having an acid group such as a carboxylic acid group, a sulfonic acid group, etc., is used, it can be incorporated into a hydrophilic colloid as an alkaline aqueous solution thereof.

The silver halide emulsions which can be used in the present invention are those wherein silver chloride, silver bromide, or a mixed silver halide such as silver chlorobromide, silver iodobromide, or silver chloroiodobromide is finely dispersed in a hydrophilic polymer such as gelatin. The silver halide can be chosen depending on the intended use of the photographic light-sensitive material from dispersions having a uniform grain size or those having a wide grain size distribution or from dispersions having an average grain size of from about 0.1 micron to 3 microns. These silver halide emulsions can be prepared, for example, by a single jet method, by a double jet method or a controlled double jet method, or by a ripening method such as an ammonia method, a natural method, or an acid method. Also, these silver halide emulsions can be subjected to chemical sensitization such as a sulfur sensitization, a gold sensitization, a reduction sensitization, etc., and can contain a speed increasing agent such as a polyoxyethylene compound, an onium compound, etc. Further, a silver halide emulsion of the type wherein latent images are predominantly formed on the surface of the grains or of the type where latent images are predominantly formed inside the grains can be used in the present invention. Also, two or more kinds of silver halide photographic emulsions prepared separately and then mixed can be employed.

As a hydrophilic high molecular weight substance composed of the photographic light-sensitive layer of the present invention, a protein such as gelatin, etc., a high molecular weight non-electrolyte such as polyvinyl alcohol, polyvinyl pyrrolidone, polyacrylamide, etc., an acidic polymer such as an alginate, a polyacrylic acid salt, etc., a high molecular weight ampholite such as a polyacrylamide treated by the Hoffman rearrangement reaction, a copolymer of acrylic acid and N-vinylimidazole, etc., a cross-linking polymer as described in U.S. Pat. No. 4,215,195, and the like are suitable. Furthermore, a hydrophobic polymer dispersion such as a latex of polybutyl acrylate, etc., can be included in the continuous phase of such a hydrophilic high molecular weight substance.

The silver halide emulsion used in the present invention can be chemically sensitized, as noted above, using conventional methods. Examples of suitable chemical sensitizers include, for example, gold compounds such as chloroaurates and gold trichloride as described in U.S. Pat. Nos. 2,399,083, 2,540,085, 2,597,856, and 2,597,915; salts of a noble metal, such as platinum, palladium, iridium, rhodium and ruthenium, as described in U.S. Pat. Nos. 2,448,060, 2,540,086, 2,566,245, 2,566,263 and 2,598,079; sulfur compounds capable of forming silver sulfide by reacting with a silver salt, such as those described in U.S. Pat. Nos. 1,574,944, 2,410,689, 3,189,458 and 3,501,313; stannous salts, amines, and other reducing compounds such as those described in U.S. Pat. Nos. 2,487,850, 2,518,698, 2,521,925, 2,521,926, 2,694,637, 2,983,610 and 3,201,254 and the like.

Various compounds can be added to the photographic emulsions used in the present invention in order to prevent a reduction of the sensitivity or a formation of fog during preparation, storage, or processing. A wide variety of such compounds are known, such as heterocylic compounds, mercury-containing compounds, mercapto compounds or metal salts, including 4-hydroxy-6-methyl-1,3,3a,7-tetraazaindene, 3-methylbenzothiazole and 1-phenyl-5-mercaptotetrazole. Other examples of such compounds which can be used are described, for example, in U.S. Pat. Nos. 1,758,576, 2,110,178, 2,131,038, 2,173,628, 2,697,040, 2,304,962, 2,324,123, 2,394,198, 2,444,605, 2,444,606, 2,444,607, 2,444,608, 2,566,245, 2,694,716, 2,697,099, 2,708,162, 2,728,663, 2,728,664, 2,728,665, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668 and 3,622,339, British Pat. Nos. 893,428, 403,789, 1,173,609 and 1,200,188, as well as in K. Mees, *The Theory of the Photographic Process,* 3rd Ed. (1966) and the literature references cited therein.

The photographic emulsion used in the present invention can also contain one or more surface active agents. These surface active agents are commonly used as a coating aid. However, in some cases they are used as an emulsifier, a dispersant, a sensitizer, an antistatic agent, or an adhesion preventing agent.

The surface active agents can be classified into various groups, as follows: natural surface active agents such as saponin; nonionic surface active agents such as alkylene oxides, glycerols and glycidols; cationic surface active agents such as higher alkylamines, quaternary ammonium salts, heterocyclic compounds such as pyridine and the like, phosphoniums or sulfoniums; anionic surface active agents containing an acid group such as a carboxylic acid group, a sulfonic acid group, a phosphoric acid group, a sulfuric acid ester group, or phosphoric acid ester group; amphoteric surface active agents such as aminoacids, aminosulfonic acids, aminoalcohol sulfuric acid esters or aminoalcohol phosphoric acid esters. Some examples of those surface active agents which can be used are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, 3,545,974, West German Patent Application (OLS) No. 1,942,665, British Pat. Nos. 1,077,317 and 1,198,450, as well as Ryohei Oda et al., *Kaimenkasseizai no Gosei to Sono Oyo (Synthesis and Application of Surface Active Agents)*, Maki Shoten (1964), A. W. Perry, *Surface Active Agents,* Interscience Publications, Inc. (1958) and J. P. Sisley, *Encyclopedia of Surface Active Agents,* Vol. II, Chemical Publishing Co. (1964).

The photographic emulsions can be spectrally sensitized, or supersensitized, using a cyanine-type dye, such as a cyanine, merocyanine, carbocyanine, etc., individually, in combinations, or in combination with a styryl dye.

These spectral sensitization techniques are well known, and are described, for example, in U.S. Pat. Nos. 2,688,545, 2,912,329, 3,397,060, 3,615,635 and 3,628,964, British Pat. Nos. 1,195,302, 1,242,588 and 1,293,862, West German Patent Application (OLS) Nos. 2,030,326 and 2,121,780, Japanese Patent Publication Nos. 4936/68 and 14030/69, etc. The sensitizers can be selected as desired depending on the purposes and use of the photographic materials, for example, a wavelength region to be sensitized, a sensitivity, or etc.

The hydrophilic colloid layer, and in particular, a gelatin layer in the photographic light-sensitive material used in the present invention, can be hardened using various kinds of cross-linking agents. For instance, an inorganic compound such as a chromium salt and a zirconium salt, or an aldehyde type cross-linking agent such as mucochloric acid, or 2-phenoxy-3-chloromalealdehydic acid as described in Japanese Patent Publication No. 1872/71 can be effectively used in the present invention. However, non-aldehyde type cross-linking agents such as compounds having plural epoxy rings as described in Japanese Patent Publication No. 7133/59, the poly(1-aziridinyl) compounds as described in Japanese Patent Publication No. 8790/62, the active halogen compounds as described in U.S. Pat. Nos. 3,362,827 and 3,325,287 and the vinyl sulfone compounds as described in U.S. Pat. Nos. 2,994,611 and 3,582,322, Belgian Pat. No. 686,440, etc., are particularly suitable for use in the photographic light-sensitive material of the present invention.

The silver halide photographic emulsion of the present invention is suitably applied to a support. Illustrative supports include rigid materials such as glass, metal and ceramics, and flexible materials and the type of support chosen depends on the end-use objects. Typical examples of flexible supports include a cellulose nitrate film, a cellulose acetate film, a polyvinyl acetal film, a polystyrene film, a polyethylene terephthalate film, a polycarbonate film and a laminate thereof, a baryta coated paper, a paper coated with an $\alpha$-olefin polymer, such as polyethylene, polypropylene and an ethylene-butene copolymer, a plastic film having a roughened surface as described in Japanese Patent Publication No. 19068/72, and the like. Depending upon the end-use objects of the photographic light-sensitive material, the support can be transparent, colored by adding a dye or pigment, opaque by adding, for example, titanium white, or light-shielding by adding, for example, carbon black.

The layer of the photographic light-sensitive material can be coated on a support using various coating methods, including a dip coating method, an air-knife coating method, a curtain coating method, an extrusion coating method using a hopper as described in U.S. Pat. No. 2,681,294. Also, two or more layers can be coated simultaneously, using methods as described in U.S. Pat. Nos. 2,761,791, 3,508,947, 2,941,898, 3,526,528, etc.

The present invention is applicable to not only the so-called multilayer type photographic light-sensitive material comprising a support having superimposed thereon emulsion layers, each of which is sensitive to radiation of a substantially different wavelength region and forms color images of a substantially different hue, but also the so-called mixed packet type photographic light-sensitive material comprising a support having coated thereon a layer containing packets which are sensitive to radiation of substantially different wavelength regions and form color images of a substantially different hue. The present invention can be applied to a color negative film, a color positive film, a color reversal film, a color printing paper, a color reversal printing paper, and the like.

The color photographic light-sensitive material of the present invention is, after exposure, subjected to a development processing to form dye images. Development processing includes basically a color development step, a bleaching step and a fixing step. Each step can be carried out individually or two or more steps can be combined as one step where a processing solution having two or more functions is used. Also, each step can be separated into two or more steps. The development processing can further include a prehardening step, a neutralization step, a first development (black-and-white development) step, a stabilizing step, a water washing step, and the like, if desired. The temperature of processing can be varied depending on the photographic light-sensitive material, the processing method, and the like. In general, the processing steps are carried out at a temperature from 18° C. to 60° C. These steps need not necessarily be conducted at the same temperature.

A color developer solution is an alkaline solution having a pH of more than 8, preferably from 9 to 12, and containing, as a developing agent, a compound whose oxidation product is capable of forming a colored compound when reacted with a color forming agent, i.e., a color coupler. The developing agent described above includes a compound capable of developing an exposed silver halide and having a primary amino group on an aromatic ring, and a precursor which forms such compound. Typical examples of preferred developing agents are, for example, 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 4-amino-3-methyl-N-ethyl-N-$\beta$-methanesulfonamidoethylaniline, 4-amino-N,N-dimethylaniline, 4-amino-3-methoxy-N,N-diethylaniline, 4-amino-3-methyl-N-ethyl-N-$\beta$-ethoxyethylaniline, 4-amino-3-methoxy-N-ethyl-N-$\beta$-methoxyethylaniline, 4-amino-3-$\beta$-methanesulfonamidoethyl-N,N-diethylaniline, and the salts thereof (for example, the sulfates, the hyrochlorides, the sulfites, the p-toluenesulfonates, and the like). Other developing agents such as those described in U.S. Pat. Nos. 2,193,015 and 2,592,364, Japanese Patent Application (OPI) No. 64933/73, L. F. A. Mason, *Photographic Processing Chemistry,* pages 226–229, Focal Press, London (1966), T. H. James, *The Theory of the Photographic Process,* 4th Edition, pages 315–320, Macmillan, New York (1977), etc., can be used. Further, an aminophenol as described in T. H. James, *The Theory of the Photographic Process,* 4th Edition, pages 311–315, etc., can be used. Also, a 3-pyrazolidone developing agent can be used together with these developing agents.

The color developer solution can optionally contain various additives. Typical examples of such additives include alkaline agents (for example, alkali metal or ammonium hydroxides, carbonates or phosphates); pH-adjusting agents or buffers (for example, weak acids such as acetic acid, boric acid, etc., weak bases, or salts thereof); developing accelerators (for example, various pyridinium compounds or cationic compounds such as those described in U.S. Pat. Nos. 2,648,604 and 3,671,247; potassium nitrate; sodium nitrate; condensation products of polyethylene glycol, and their derivatives such as those described in U.S. Pat. Nos. 2,533,990, 2,577,127 and 2,950,970; nonionic compounds such as polythioethers represented by those described in British Pat. Nos. 1,020,033 and 1,020,032; polymeric compounds having sulfite ester groups such as those described in U.S. Pat. Nos. 3,068,097; organic amines such as pyridine and ethanolamine; benzyl alcohol; hydrazines and the like); anti-fogging agents (for example, alkali metal bromides; alkali metal iodides; nitrobenzimidazoles such as those described in U.S. Pat. Nos. 2,496,940 and 2,656,271; mercaptobenzimidazole; 5-methylbenztriazole; 1-phenyl-5-mercaptotetrazole; compounds for use in rapid processing such as those described in U.S. Pat. Nos. 3,113,864, 3,342,596, 3,295,976, 3,615,522 and 3,597,199; thiosulfonyl compounds such as those described in British Pat. No. 972,211; phenazine-N-oxides such as those described in Japanese Patent Publication No. 41675/71; those described in *Kagaku Shashin Binran* (*Manual of Scientific Photography*), Vol. II, pages 29–47, and the like); stain or sludge preventing agents such as those described in U.S. Pat. Nos. 3,161,513 and 3,161,514, and British Pat. Nos. 1,030,442, 1,144,481 and 1,251,558; interlayer-effect accelerators disclosed in U.S. Pat. No. 3,536,487; preservatives (for example, sulfites, bisulfites, hydroxyamine hydrochloride, formsulfite, alkanolaminesulfite adducts, etc.) and the like.

The color photographic light-sensitive material of the present invention can be treated with various solutions prior to color development.

In the case of color reversal films, treatment with a first development solution is also carried out prior to the color development. As the first development solution, an alkaline aqueous solution containing at least one developing agent, such as hydroquinone, 1-phenyl-3-pyrazolidone, N-methyl-p-aminophenol and the like can be employed. The solution can also contain inorganic salts such as sodium sulfate; pH-adjusting agents or buffers such as borax, boric acid, sodium hydroxide and sodium carbonate, development fog inhibitors such as alkali metal halides (such as potassium bromide, etc.), and the like.

The additives illustrated above and the amounts thereof employed are well known in the color processing field.

After color development, the color photographic materials are usually bleached and fixed. The processes can be effected in a blix bath which combines the bleaching and fixing steps. Various compounds can be used as a bleaching agent, for example, ferricyanides, dichromates; water-soluble iron (III) salts, water-soluble cobalt (III) salts; water-soluble copper (II) salts; water-soluble quinones; nitrosophenols, complex salts of a polyvalent cation such as iron (III), cobalt (III), copper (II), etc., and an organic acid, for example, metal complex of an aminopolycarboxylic acid such as ethylenediaminetetraacetic acid, nitrilotriacetic acid, iminodiacetic acid, N-hydroxyethylethylenediaminetriacetic acid, etc., malonic acid, tartaric acid, malic acid, diglycolic acid and dithioglycolic acid, and copper complex salt of 2,6-dipicolinic acid; peracids such as alkylperacids, persulfates, permanganates and hydrogen peroxide; hypochlorites; chlorine; bromine; bleaching powder; and the like. These can be suitably used, individually or in combination. To the bleaching solution, bleaching accelerators such as those described in U.S. Pat. Nos. 3,042,520 and 3,241,966, Japanese Patent Publication Nos. 8506/70 and 8836/70 and various other additives can be added.

Any known fixing solution can be used for fixing the photographic materials of the present invention. That is, ammonium, sodium, or potassium thiosulfate can be used as a fixing agent at a concentration of about 50 to about 200 g/liter. Fixing solutions can further contain stabilizers such as sulfites and metabisulfites; hardeners such as potassium alum; pH buffers such as acetates and borates, and the like.

Bleaching baths, fixing baths and blixing baths as described, for example, in U.S. Pat. No. 3,582,322, Japanese Patent Application (OPI) No. 101934/73, West German Pat. No. 1,051,117 can also be employed.

The present invention will be explained in greater detail with reference to the following examples, but the present invention should not be construed as beling limited thereto.

Example 1

20 g of each of Hydrophobic Polymer Couplers (XVII) and (III) according to the present invention and Comparative Hydrophobic Polymer Coupler (b) which was synthesized according to the Synthesis Method II was dissolved by heating in 50 ml of ethyl acetate and the solution was mixed with 10 ml of a 10% by weight aqueous solution of Alkanol B (alkylnaphthalene sulfonate, made by E. I. Du Pont de Nemours and Co.) and 200 ml of a 4.0% by weight aqueous gelatin solution. The mixture was stirred at a high speed using a homogenizer to prepare Hydrophobic Polymer Coupler Latexes (XVII'), (III') and (b'), respectively.

Each of the 2-equivalent Magenta Polymer Coupler Latex (XVII'), (III') and (W) according to the present invention, Comparative Magenta Polymer Coupler Latex (a) synthesized according to Synthesis Method I and Comparative Magenta Polymer Coupler Latex (b') containing $5.6\times10^{-3}$ mol of the coupler unit was mixed with 100 g of a silver halide emulsion containing $5.6\times10^{-2}$ mol of silver iodobromide and 7 g of gelatin, and to the mixture was added 8 ml of a 4% acetone solution of 2-hydroxy-4,6-dichloro-s-triazine sodium salt. After adjusting the pH to 6.7, the mixture was coating on a cellulose triacetate film having a subbing layer in an amount of silver coated of $1.2\times10^{-3}$ mol/m$^2$ to prepare Samples 1 to 5.

These films were exposed stepwise for sensitometry and then subjected to the following color development processing.

| Color Development Processing Step (38° C.) | Time (min) |
|---|---|
| 1. First development | 3 |
| 2. Washing with water | 1 |
| 3. Reversal | 2 |
| 4. Color development | 6 |
| 5. Control | 2 |
| 6. Bleaching | 6 |
| 7. Fixing | 4 |
| 8. Washing with water | 4 |
| 9. Stabilizing | 1 |
| 10. Drying | |

The processing solutions used in the color development processing had the following compositions:

| | |
|---|---|
| First Development Solution | |
| Water | 800 ml |
| Sodium Tetrapolyphosphate | 2.0 g |
| Sodium Hydrogensulfite | 8.0 g |
| Sodium Sulfite | 37.0 g |
| 1-Phenyl-3-pyrazolidone | 0.35 g |
| Hydroquinone | 5.5 g |
| Sodium Carbonate Monohydrate | 28.0 g |
| Potassium Bromide | 1.5 g |
| Potassium Iodide | 13.0 mg |
| Sodium Thiocyanate | 1.4 g |
| Water to make | 1.0 l |
| Reversal Solution | |
| Water | 800 ml |
| Hexasodium Nitrilo-N,N,N—trimethylene Phosphonate | 3.0 g |
| Stannous Chloride Dihydrate | 1.0 g |
| Sodium Hydroxide | 8.0 g |
| Glacial Acetic Acid | 15.0 ml |
| Water to make | 1.0 l |
| Color Development Solution | |
| Water | 800 ml |
| Sodium Tetrapolyphosphate | 2.0 g |
| Benzyl Alcohol | 5.0 ml |
| Sodium Sulfite | 7.5 g |
| Trisodium Phosphate (12 hydrate) | 36.0 g |
| Potassium Bromide | 1.0 g |
| Potassium Iodide | 90.0 mg |
| Sodium Hydroxide | 3.0 g |
| Citrazic Acid | 1.5 g |
| 4-Amino-3-methyl-N—ethyl-N—(β-hydroxyethyl)aniline Sesquisulfate Monohydrate | 11.0 g |
| Ethylenediamine | 3.0 g |
| Water to make | 1.0 l |
| Control Solution | |
| Water | 800 ml |
| Glacial Acetic Acid | 5.0 ml |
| Sodium Hydroxide | 3.0 g |
| Dimethylaminoethaneisothiourea Dihydrochloride | 1.0 g |
| Water to make | 1.0 l |
| Bleaching Solution | |
| Water | 800 ml |
| Sodium Ethylenediaminetetraacetate Dihydrate | 2.0 g |
| Ammonium Iron (II) Ethylenediaminetetraacetate Dihydrate | 120.0 g |
| Potassium Bromide | 100.0 g |
| Water to make | 1.0 l |
| Fixing Solution | |
| Water | 800 ml |
| Ammonium Thiosulfate | 80.0 g |
| Sodium Sulfite | 5.0 g |
| Sodium Hydrogensulfite | 5.0 g |
| Water to make | 1.0 l |
| Stabilizing Bath | |
| Water | 800 ml |
| Formalin (37 wt % formaldehyde) | 5.0 ml |

-continued

| | |
|---|---|
| Fuji Driwel | 5.0 ml |
| Water to make | 1.0 l |

The photographic properties thus-obtained are shown in Table 1 below.

Further, each sample was exposed stepwise and subjected to the color development processing as described above. Then, the graininess was measured with green light in areas having a color density of 0.5 and 1.0 respectively and the results obtained are also shown in Table 1 below. The graininess was determined according to a conventional RMS (Root Mean Square) method and shown with the value obtained by magnifying 100 times a standard deviation of change in density measured when scanning using a microdensitometer having a round scanning diameter of 4.8μ. The smaller the value, the better the graininess.

Furthermore, each sample was contacted with a formaldehyde vapor of (A) 0 ppm or (B) 20 ppm at 45° C. and 70% relative humidity for 12 hours. Then, the sample was exposed stepwise for sensitometry and subjected to the color development processing as described above. The formalin resistivity, i.e., a ratio of (Dmax) B/(Dmax) A thus obtained is also shown in Table 1 below.

TABLE 1

| Sample | Latex Used | Color Forming Properties: Fog | Gamma | Maximum Color Density | Graininess (RMS × 100) $D_{0.5}$ | $D_{1.0}$ | Formalin Resistivity $\frac{(Dmax)\ B}{(Dmax)\ A} \times 100$ (%) |
|---|---|---|---|---|---|---|---|
| 1 (Present Invention) | (XVII') | 0.05 | 1.81 | 2.72 | 1.2 | 2.1 | 98 |
| 2 (Present Invention) | (III') | 0.04 | 1.75 | 2.56 | 1.2 | 2.0 | 100 |
| 3 (Present Invention) | (W) | 0.05 | 1.92 | 2.80 | 1.3 | 2.3 | 98 |
| 4 (Comparison) | (a) | 0.05 | 1.47 | 1.95 | 1.7 | 2.7 | 53 |
| 5 (Comparison) | (b') | 0.05 | 1.30 | 1.73 | 1.6 | 2.8 | 67 |

From the results shown in Table 1 above, it is apparent that the 2-equivalent magenta polymer coupler latexes according to the present invention are superior to the comparative magenta polymer coupler latexes with respect to both the color forming properties, the graininess and the formalin resistivity.

The comparative magenta polymer coupler latex and the comparative hydrophobic magenta polymer coupler have the following compositions, respectively.

(a)

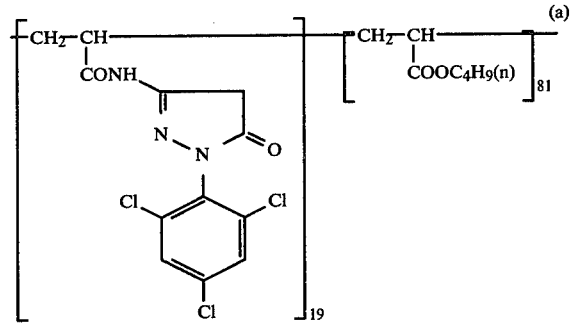

-continued

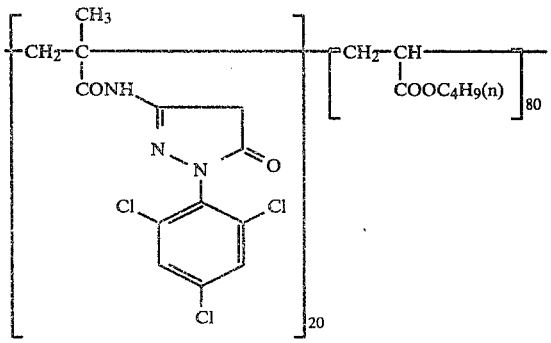

(b)

Example 2

40 g of each of Hydrophobic Polymer Couplers (VIII) and (XI) according to the present invention and Comparative Hydrophobic Polymer Couplers (e) and (f) synthesized according to Synthesis Method II was dissolved by heating in 100 ml of butyl acetate and the solution was mixed with 20 ml of a 10% by weight aqueous solution of Alkanol B and 300 ml of a 4.0% by weight aqueous gelatin solution. The mixture was stirred with a high speed using a homogenizer and the butyl acetate was removed under a reduced pressure to prepare Hydrophobic Polymer Coupler Latexes (VIII'), (XI'), (e') and (f'), respectively.

Each of Polymer Coupler Latexes (VIII'), (XI') and (T) according to the present invention, Comparative Polymer Coupler Latexes (c) and (d) synthesized according to Synthesis Method I and Comparative Polymer Coupler Latexes (e') and (f') containing $5.6\times10^{-3}$ mol of the coupler unit was mixed with 100 g of a silver halide emulsion containing $5.6\times10^{-2}$ mol of silver iodobromide and 8 g of gelatin, and to the mixture was added 8 ml of a 4% acetone solution of 2-hydroxy-4,6-dichloro-s-triazine sodium salt. After adjusting the pH to 6.5, the emulsion was coated on a cellulose triacetate support having a subbing layer to prepare Samples 6 to 12.

These samples were evaluated with respect to the graininess and the formalin resistivity in the same manner as described in Example 1 except for using the following color development processing. The results obtained are shown in Table 2 below.

| Color Development Processing Step | Time | Temperature (°C.) |
|---|---|---|
| 1. Color development | 3 min 15 sec | 38 |
| 2. Bleaching | 6 min 30 sec | " |
| 3. Washing with water | 2 min | " |
| 4. Fixing | 4 min | " |
| 5. Washing with water | 4 min | " |
| 6. Stabilizing | 1 min | " |

The processing solutions used in the color development processing had the following compositions:

| | |
|---|---|
| Color Developer Solution | |
| Water | 800 ml |
| 4-(N—Ethyl-N—hydroxyethyl)amino-2-methylaniline Sulfate | 5 g |
| Sodium Sulfite | 5 g |
| Hydroxylamine Sulfate | 2 g |
| Potassium Carbonate | 30 g |
| Potassium hydrogencarbonate | 1.2 g |
| Potassium Bromide | 1.2 g |
| Sodium Chloride | 0.2 g |
| Trisodium Nitrilotriacetate | 1.2 g |
| Water to make | 1 l |
| | (pH 10.1) |
| Bleaching Solution | |
| Water | 800 ml |
| Iron (III) Ammonium Ethylenediaminetetraacetate | 100 g |
| Disodium Ethylenediaminetetraacetate | 10 g |
| Potassium Bromide | 150 g |
| Acetic Acid | 10 g |
| Water to make | 1 l |
| | (pH 6.0) |
| Fixing Solution | |
| Water | 800 ml |
| Ammonium Thiosulfate | 150 g |
| Sodium Sulfite | 10 g |
| Sodium Hydrogensulfite | 2.5 g |
| Water to make | 1 l |
| | (pH 6.0) |
| Stabilizing Bath | |
| Water | 800 ml |
| Formalin (37 wt % formaldehyde) | 5 ml |
| Fuji Driwel | 3 ml |
| Water to make | 1 l |

The photographic properties thus-obtained are shown in Table 2 below.

TABLE 2

| Sample | Latex Used | Graininess (RMS × 100) $D_{0.5}$ | Formalin Resistivity $\frac{(Dmax)\ B}{(Dmax)\ A}\times 100$ (%) |
|---|---|---|---|
| 6 (Present Invention) | (VIII') | 1.3 | 100 |
| 7 (Present Invention) | (XI') | 1.2 | 100 |
| 8 (Present Invention) | (T) | 1.2 | 99 |
| 9 (Comparison) | (c) | 1.7 | 78 |
| 10 (Comparison) | (d) | 1.6 | 73 |
| 11 (Comparison) | (e') | 1.5 | 64 |
| 12 (Comparison) | (f') | 1.8 | 79 |

From the results shown in Table 2 above, it is apparent that the 2-equivalent magenta polymer coupler latexes according to the present invention are superior to the comparative magenta polymer coupler latexes with respect to both the graininess and the formalin resistivity.

The comparative magenta polymer coupler latexes and the comparative hydrophobic magenta polymer couplers have the following compositions, respectively.

(c)

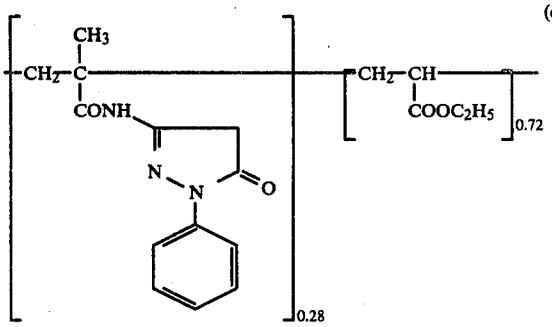

(d)

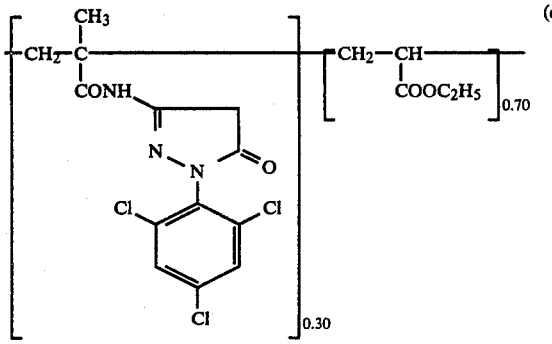

(e)

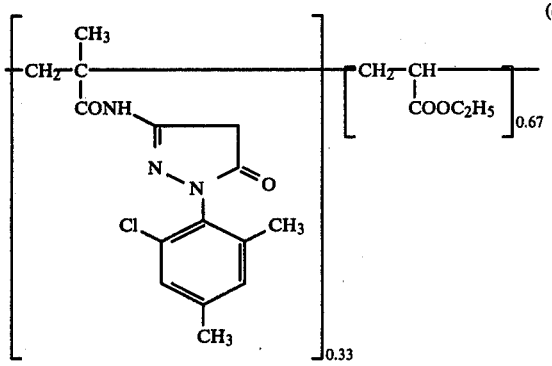

(f)

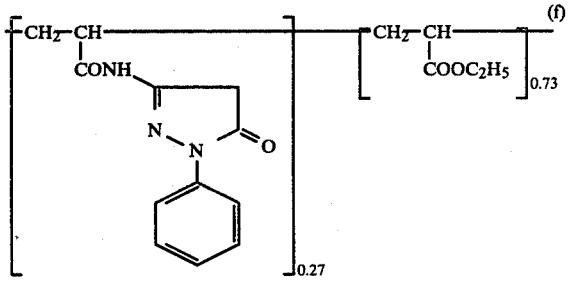

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having thereon a silver halide emulsion layer containing a magenta color image forming polymer coupler latex which is capable of forming a dye upon coupling with an oxidation product of an aromatic primary amine developing agent and which is a homopolymer or copolymer having a repeating unit derived from a monomer coupler represented by the following general formula (I):

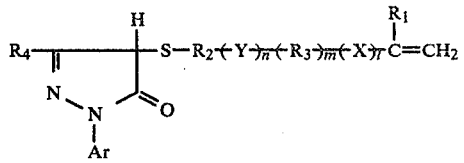

(I)

wherein $R_1$ represents hydrogen, a lower alkyl group containing from 1 to 4 carbon atoms or a chlorine atom; $R_2$ and $R_3$, which may be the same or different, each represents an unsubstituted or substituted alkylene group which may be a straight chain or a branched chain, an unsubstituted or substituted arylene group or an unsubstituted or substituted aralkylene group; X represents —CONH— or —COO—; Y represents —O—, —S—, —SO—, —$SO_2$—, —CONH— or —COO—; Ar represents an unsubstituted or substituted phenyl group; $R_4$ represents an unsubstituted or substituted anilino group, an unsubstituted or substituted acylamino group or an unsubstituted or substituted ureido group; l represents 0 or 1; m represents 0 or 1; and n represents 0 or 1.

2. A silver halide color photographic light-sensitive material as claimed in claim 1, wherein the alkylene group represented by $R_2$ is an alkylene group having from 1 to 10 carbon atoms.

3. A silver halide cclor photographic light-sensitive material as claimed in claim 1, wherein the alkylene group represented by $R_3$ is an alkylene group having from 1 to 10 carbon atoms.

4. A silver halide color photographic light-sensitive material as claimed in claim 1, wherein the substituent for the substituted alkylene group, the substituted arylene group or the substituted aralkylene group represented by $R_2$ or $R_3$ is an aryl group, a nitro group, a hydroxy group, a cyano group, a sulfo group, an alkoxy group, an aryloxy group, an acyloxy group, an acylamino group, a sulfonamido group, a sulfamoyl group, a halogen atom, a carboxy group, a carbamoyl group, an alkoxycarbonyl group or a sulfonyl group.

5. A silver halide color photographic light-sensitive material as claimed in claim 1, wherein the substituent for the substituted phenyl group represented by Ar is an alkyl group, an alkoxy group, an aryloxy group, an alkoxycarbonyl group, an acylamino group, a carbamoyl group, an alkylcarbamoyl group, a dialkylcarbamoyl group, an arylcarbamoyl group, an alkylsulfonyl group, an arylsulfonyl group, an alkylsulfonamido group, an arylsulfonamido group, a sulfamoyl group, an alkylsulfamoyl group, a dialkylsulfamoyl group, an alkylthio group, an arylthio group, a cyano group, a nitro group, or a halogen atom.

6. A silver halide color photographic light-sensitive material as claimed in claim 1, wherein the substituent for the substituted phenyl group represented by Ar is a halogen atom, an alkyl group, an alkoxy group, an alkoxycarbonyl group, or a cyano group.

7. A silver halide color photographic light-sensitive material as claimed in claim 1, wherein the substituent for the substituted anilino group, the substituted acylamino group or the substituted ureido group represented by $R_4$ is a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkyloxycarbonylamino group, an alkylureido group, an acyl group, a nitro group, a carboxy group, a sulfo group, a hydroxy group or a trichloromethyl group.

8. A silver halide color photographic light-sensitive material as claimed in claim 7, wherein the alkyl moiety and the aryl moiety included in the substituent is an alkyl group having from 1 to 36 carbon atoms and an aryl group having from 6 to 38 carbon atoms, respectively.

9. A silver halide color photographic light-sensitive material as claimed in claim 1, wherein the copolymer contains a repeating unit derived from a non-color forming ethylenic monomer which does not couple with the oxidation product of an aromatic primary amine developing agent.

10. A silver halide color photographic light-sensitive material as claimed in claim 9, wherein the non-color forming ethylenic monomer is an acrylic acid ester, an acrylic acid amide, a vinyl ester, an acrylonitrile, an aromatic vinyl compound, itaconic acid, citraconic acid, crotonic acid, vinylidene chloride, a vinyl alkyl ether, an ester of maleic acid, N-vinyl-2-pyrrolidone, N-vinyl pyridine, or 2- or 4-vinyl pyridine.

11. A silver halide color photographic light-sensitive material as claimed in claim 9, wherein the non-color forming monomer is an acrylic acid ester, a methacrylic acid ester or a maleic acid ester.

12. A silver halide color photographic light-sensitive material as claimed in claim 1, wherein the amount of the color forming portion in the polymer latex is from 5% to 80% by weight.

13. A silver halide color photographic light-sensitive material as claimed in claim 1, wherein the amount of the color forming portion in the polymer latex is from 20% to 70% by weight.

14. A silver halide color photographic light-sensitive material as claimed in claim 12, wherein the gram number of the polymer latex containing 1 mol of coupler monomer is from 250 to 3,000.

15. A silver halide color photographic light-sensitive material as claimed in claim 1, wherein the magenta color image forming polymer coupler latex is a latex prepared by emulsion polymerization of a monomer comprising a monomer coupler represented by the general formula (I).

16. A silver halide color photographic light-sensitive material as claimed in claim 1, wherein the magenta color image forming polymer coupler latex is a latex prepared by dissolving a hydrophobic polymer coupler obtained by polymerization of a monomer comprising a monomer coupler represented by the general formula (I) in an organic solvent and then dispersing the solution in a latex form in an aqueous gelatin solution.

17. A silver halide color photographic light-sensitive material as claimed in claim 1, wherein the silver halide emulsion layer containing a magenta color image forming polymer coupler latex is a green-sensitive silver halide emulsion layer.

18. A silver halide color photographic light-sensitive material as claimed in claim 17, wherein the photographic light-sensitive material further comprises a blue-sensitive silver halide emulsion layer containing a yellow color image forming coupler and a red-sensitive silver halide emulsion layer containing a cyan color image forming coupler.

19. A method of forming a color image comprising developing an imagewise exposed silver halide color photographic light-sensitive material comprising a support having thereon a silver halide emulsion layer containing a magenta color image forming polymer coupler latex which is capable of forming a dye upon coupling with an oxidation product of an aromatic primary amine developing agent and which is a homopolymer or copolymer having a repeating unit derived from a monomer coupler represented by the following general formula (I):

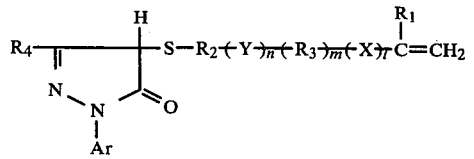

(I)

wherein $R_1$ represents hydrogen, a lower alkyl group containing from 1 to 4 carbon atoms or a chlorine atom; $R_2$ and $R_3$, which may be the same or different, each represents an unsubstituted or substituted alkylene group which may be a straight chain or a branched chain, an unsubstituted or substituted arylene group or an unsubstituted or substituted aralkylene group; X represents —CONH— or —COO—; Y represents —O—, —S—, —SO—, —$SO_2$—, —CONH— or —COO—; Ar represents an unsubstituted or substituted phenyl group; $R_4$ represents an unsubstituted or substituted anilino group, an unsubstituted or substituted acylamino group or an unsubstituted or substituted ureido group; l represents 0 or 1; m represents 0 or 1; and n represents 0 or 1; wherein said developing is conducted using an alkaline aqueous solution containing an aromatic primary amine developing agent.

* * * * *